US007846631B2

(12) United States Patent
Katsuta et al.

(10) Patent No.: US 7,846,631 B2
(45) Date of Patent: Dec. 7, 2010

(54) TONER

(75) Inventors: Yasushi Katsuta, Suntou-gun (JP); Koji Inaba, Hadano (JP); Ken-ichi Nakayama, Numazu (JP); Kenta Kamikura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/356,221

(22) Filed: Jan. 20, 2009

(65) Prior Publication Data

US 2009/0130583 A1 May 21, 2009

Related U.S. Application Data

(63) Continuation of application No. PCT/JP2008/067728, filed on Sep. 30, 2008.

(30) Foreign Application Priority Data

Oct. 1, 2007 (JP) ..... 2007-257590
Apr. 9, 2008 (JP) ..... 2008-101528

(51) Int. Cl.
*G03G 9/00* (2006.01)

(52) U.S. Cl. ..... 430/108.4; 430/110.2; 430/111.35

(58) Field of Classification Search ..... 430/108.4, 430/110.2, 111.35
See application file for complete search history.

(56) References Cited

U.S. PATENT DOCUMENTS 5,358,811 A 10/1994 Yamazaki et al. ..... 430/42
5,565,293 A 10/1996 Akiyama et al. ..... 430/109
5,604,074 A 2/1997 Yasuda et al. ..... 430/120
5,679,490 A 10/1997 Yachi et al. ..... 430/110
6,132,919 A 10/2000 Ogawa et al. ..... 430/110
6,226,488 B1 5/2001 Maeyama ..... 399/322
2004/0142268 A1 7/2004 Yamanouchi et al. .... 430/111.4
2004/0191659 A1 * 9/2004 Nakamura et al. ..... 430/108.8
2005/0058927 A1 * 3/2005 Mikuriya et al. ..... 430/110.2
2007/0212631 A1 9/2007 Abe et al. ..... 430/109.3

FOREIGN PATENT DOCUMENTS

JP 2002-091060 3/2002
JP 2004-038197 2/2004
JP 2004-184561 7/2004
JP 2004-294839 10/2004
JP 2005-300937 10/2005
JP 2006-011490 1/2006
JP 2006-267301 10/2006
JP 2007-108466 4/2007
JP 2007-171221 7/2007

* cited by examiner

*Primary Examiner*—John L Goodrow
(74) *Attorney, Agent, or Firm*—Fitzpatrick, Cella, Harper & Scinto

(57) ABSTRACT

Provided is a toner including toner particles each containing at least a binder resin, a colorant, and a wax component, and an inorganic fine powder, the toner being wherein: in a microscopic compression test on the toner, a recovery ratio Z(25) and the gradient of a load-displacement curve R(25) each satisfy a specific range; and the toner has a glass transition temperature (TgA) measured with a differential scanning calorimeter (DSC) in a specific range and a temperature (P1) of the highest endothermic peak measured with the DSC in a specific range, and the temperature (P1) of the highest endothermic peak and the glass transition temperature (TgA) satisfy a specific relationship.

10 Claims, 4 Drawing Sheets

TONER

CROSS-REFERENCE TO RELATED APPLICATIONS

This application is a CON of PCT/JP 2008/067728 and claims the benefit of priority to the entire subject matter related to Japanese Patent Application No. 2007-257590 filed on Oct. 1, 2007 and Japanese Patent Application No. 2008-101528 filed on Apr. 9, 2008 incorporated herein by reference.

BACKGROUND OF THE INVENTION

1. Field of the Invention

The present invention relates to a toner to be used in a recording method such as an electrophotographic method, an electrostatic recording method, a magnetic recording method, or a toner jet method.

2. Description of the Related Art

An electrophotographic method involves: forming an electric latent image on a photosensitive member by any one of the various means; developing the latent image with toner to form a toner image; transferring the toner image onto a recording material (transfer material) such as paper; and fixing the toner image on the recording material with heat or pressure to provide a print or copied article.

With the advent of developed computers and developed multimedia, means for outputting a full-color image having additionally high definition has been recently demanded in a wide variety of fields ranging from offices to households. Heavy users require such high durability that image quality does not reduce even after copying or printing on a large number of sheets. In contrast, in a small office or household, from the viewpoints of space savings and energy savings, the following properties have been demanded while the acquisition of a high-quality image is attained: a reduction in size of an apparatus, the recycling of waste toner or the prevention of the production of waste toner (the removal of a cleaner), a reduction in fixation temperature, and image gloss for corresponding to photographic image quality.

The viscoelastic characteristic and melt viscosity of toner have been discussed from the viewpoint of compatibility between the durability and fixing performance of the toner. Since toner generally receives a mechanical frictional force in a developing assembly to deteriorate the toner, an improvement in viscoelastic characteristic or melt viscosity of the toner is advantageous for the suppression of the deterioration. However, the viscoelastic characteristic or melt viscosity of the toner must be lowered in order that low-temperature fixation or image gloss may be realized by curtailing an energy consumption in a fixing step. In addition, a reduction in viscoelastic characteristic or melt viscosity of the toner not only provides obstacles to developing property and transferring property but also reduces the storage stability of the toner in an environment having a temperature around 50° C. On the other hand, a wax component in each particle of the toner preferably bleeds as instantaneously as possible (bleeding performance is preferably as high as possible) in the fixing step because the releasing performance of the toner from a fixing roller becomes favorable. However, when the wax component bleeds in a developing step, developing performance may deteriorate owing to insufficient charging of the toner due to the wax component. Investigations have been conducted on an approach to achieving compatibility between durability and fixing performance, which are mutually contradictory as described above.

Some attempts to achieve compatibility between durability and fixing performance are each based on attention paid on the DSC curve of toner in a differential scanning calorimeter (DSC). A toner containing at least a binder resin and a colorant and having the following characteristic has been proposed (Patent Document 1): at least one exothermic peak is present near the glass transition point of the binder resin in a second temperature increase process of the DSC curve of the toner measured with a differential scanning calorimeter. Although the fixing performance of the toner can be improved by the approach, the approach generally requires a further improvement in consideration of durability related to developing property at temperatures around room temperature.

On the other hand, when one wishes to achieve compatibility between the durability and fixing performance of toner while taking the internal structure of each particle of the toner into consideration, the durability and fixing performance of any one particle of the toner must be discussed, and the hardness (microscopic compression hardness) of any one particle of the toner can be an effective indication: the hardness (microscopic compression hardness) of any one particle of the toner represents the extent to which the toner particle deforms (elastically or plastically). Therefore, the microscopic compression hardness of the toner can be an effective indication of transferring performance as well as the durability and the fixing performance in a transferring step where a toner particle may deform owing to a pressure applied to the particle like contact transfer.

For example, the following has been disclosed (Patent Documents 2 and 3): in a capsule toner (of a core-shell structure) constituted of a thermofusible core (core) formed of a thermoplastic resin having a low glass transition point and an outer shell (shell) mainly formed of amorphous polyester, a relationship between a displacement by which one particle of the toner is compressed upon application of a load to the particle and the load is specified in a specific range, whereby compatibility among low-temperature fixability, offset resistance, and durability can be achieved. The capsule toner is effective in a heat-pressure fixing step because the toner is of such a structure that the core having a low glass transition point is coated with a relatively thick shell layer. However, the capsule toner has difficulty in satisfying low-temperature fixability or high image gloss in a light-load fixing step.

In addition, the following has been disclosed (Patent Document 4): an association method toner in which a high-molecular weight body and a low-molecular weight body are caused to exist in a toner binder resin so that each toner particle is provided with a certain hardness is excellent in durability without involving any detrimental effect caused by a triboelectric charging action due to a toner carrying member and a toner layer control member in a non-magnetic, one-component developing system. The storage stability and hot offset resistance of the association method toner, which is a toner obtained through a step of subjecting a resin particle and a colorant particle to salting out and melt adhesion, may reduce because the structure of the resin particle is controlled so that the molecular weight of the resin of which each layer is constituted may reduce from the central portion of the particle to the surface layer of the particle.

Further, it has been disclosed that, when a toner having the following characteristics is used, the toner easily splits in a fixing step, but is excellent in durability in a developing device and provides stable charging property (Patent Document 5): a load-displacement curve obtained by subjecting the particles of the toner to a microscopic compression test has a point of inflection, and the load at the point of inflection is larger than a load which the toner receives in a developing assembly. Although the toner can satisfy fixing performance in the fixing step, the toner cannot satisfy low-temperature fixability in corresponding to the reduction of the load or an increase in speed in the fixing step, and, furthermore, the toner hardly provides high image gloss.

As described above, a large number of investigations on compatibility between durability and fixing performance taking the internal structure of a toner particle into consideration have been conducted. However, in today's circumstances where an additional increase in speed and a full-color image having additionally high definition are requested, such investigations are still insufficient, and a toner capable of sufficiently satisfying high durability, high transferring performance, and, furthermore, storage stability while maintaining good fixing performance and high image gloss has been demanded.

[Patent Document 1] JP 2004-184561 A

[Patent Document 2] JP 03003018 B

[Patent Document 3] JP 03391931 B

[Patent Document 4] JP 2004-109601 A

[Patent Document 5] JP 2005-300937 A

SUMMARY OF THE INVENTION

An object of the present invention is to provide a toner which: has improved fixing performance and improved image gloss; provides stable developing performance and stable transferring performance even after images have been printed out on a large number of sheets; and, furthermore, has improved storage stability.

The present invention relates to a toner, including: toner particles each containing at least a binder resin, a colorant, and a wax component; and an inorganic fine powder, characterized in that: in a case where, in a microscopic compression test on the toner at a measurement temperature of Y° C., a displacement (μm) obtained when a load is applied to one particle of the toner at a loading rate of $9.8\times10^{-5}$ N/sec to reach a maximum load of $2.94\times10^{-4}$ N is defined as a displacement $X_{2(Y)}$, a displacement (μm) obtained when the particle is left to stand for 0.1 second at the maximum load after the load has reached the maximum load is defined as a maximum displacement $X_{3(Y)}$, a displacement (μm) obtained when the load is reduced at an unloading rate of $9.8\times10^{-5}$ N/sec to reach 0 N after the standing for 0.1 second is defined as a displacement $X_{4(Y)}$, a difference between the maximum displacement $X_{3(Y)}$ and the displacement $X_{4(Y)}$ is defined as an elastic displacement $(X_{3(Y)}-X_{4(Y)})$, and a percentage $[\{(X_{3(Y)}-X_{4(Y)})/X_{3(Y)}\}\times100$: recovery ratio] of the elastic displacement $(X_{3(Y)}-X_{4(Y)})$ to the maximum displacement $X_{3(Y)}$ is represented by Z(Y) (%), Z(25) when the measurement temperature Y is 25° C. satisfies a relationship of $40\leqq Z(25)\leqq80$, and Z(50) when the measurement temperature Y is 50° C. satisfies a relationship of $10\leqq Z(50)\leqq55$;

when, in a load-displacement curve obtained by plotting a load and a displacement in the microscopic compression test on the toner at a measurement temperature of 25° C., a gradient of the load-displacement curve from the origin to the maximum load is represented by R(25) [$2.94\times10^{-4}$/displacement $X_{2(25)}$] (N/μm), R(25) satisfies a relationship of $0.49\times10^{13}\leqq R(25)\leqq1.70\times10^{-3}$;

and the toner has a glass transition temperature (TgA) measured with a differential scanning calorimeter (DSC) of 40° C. or higher and 60° C. or lower and a peak temperature (P1) of a highest endothermic peak measured with the DSC of 70° C. or higher and 110° C. or lower, and the peak temperature (P1) of the highest endothermic peak and the glass transition temperature (TgA) satisfy a relationship of $15°\ C.\leqq(P1-TgA)\leqq70°\ C.$ According to the present invention, there can be provided a toner having the following characteristics: a specific load-displacement curve is obtained by a microscopic compression test on the toner, and a specific DSC curve is obtained by the differential scanning calorimetry (DSC) of the toner, whereby the toner has improved fixing performance and improved image gloss, and provides stable developing performance and stable transferring performance even after images have been printed out on a large number of sheets, and, furthermore, the toner has good storage stability.

Further features of the present invention will become apparent from the following description of exemplary embodiments (with reference to the attached drawings).

DESCRIPTION OF REFERENCE NUMERALS

Figure 1:
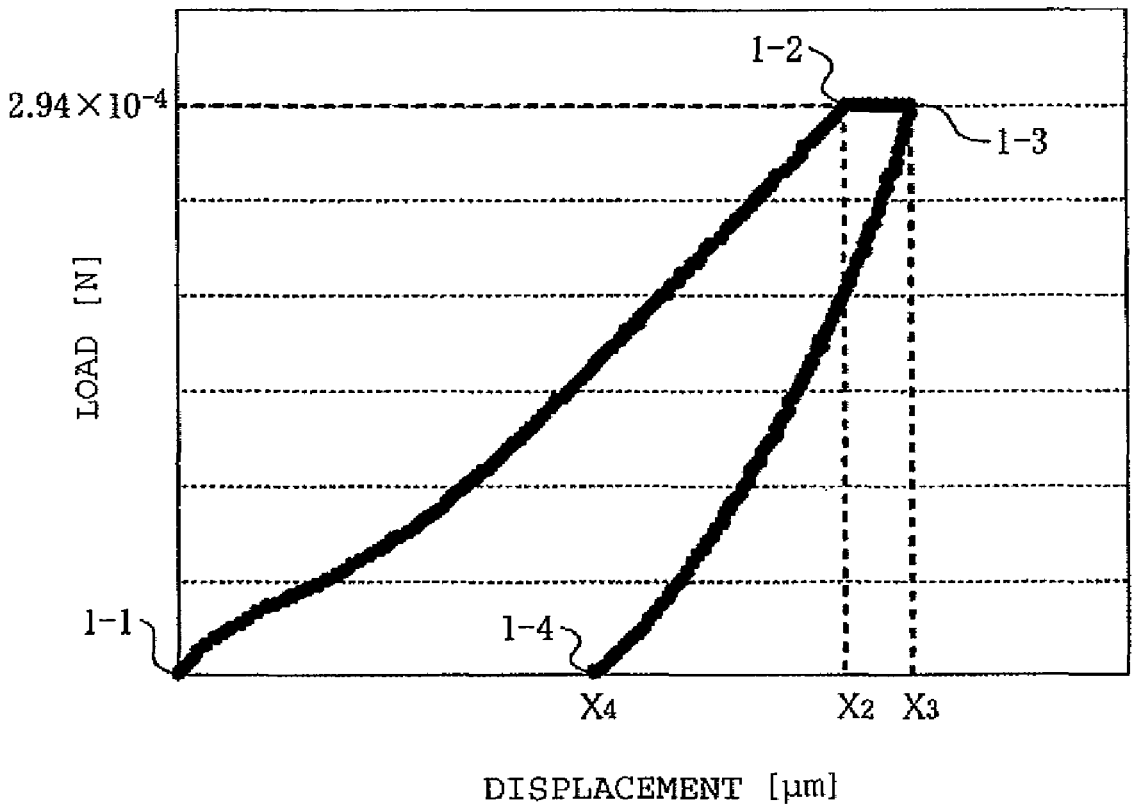
FIG. 1 is a load-displacement curve in a microscopic compression test on a toner.

10 electrostatic latent image bearing member
11 electrostatic latent image bearing member contact charging member
12 power supply
13 developing unit
14 toner carrying member
15 toner feeding roller
16 control member
17 non-magnetic toner
23 developer container
24 control member support plate
27 power supply
29 charging roller
30 suppressing member
101*a~d* photosensitive drum
102*a~d* primary charging means
103*a~d* scanner
104*a~d* developing portion
106*a~d* cleaning means
108*b* sheet feeding roller
108*c* resist roller
109*a* transport belt
109*b* driver roller
109*c* fixed roller
109*d* tension roller
110 fixing unit
110*c* discharge roller
113 discharge tray
S recording medium

DESCRIPTION OF THE EMBODIMENTS

When R(25) and Z(25) described above satisfy the above relationships, the toner particles each adopt a structure having a shell layer having an optimum hardness. As a result, the durability of the toner is improved, a core portion can be designed to be sufficiently soft, and improvements in, for example, low-temperature fixability and image gloss of the toner can also be realized.

In addition, when R(25) and (P1−TgA) described above satisfy the above relationships, the bleeding performance of the wax component at the time of the heating and pressurization of the toner is improved, and the storage stability of the toner becomes favorable while the bleeding of the wax component at the time of fixation is promoted. Accordingly, the low-temperature fixability, winding resistance, and storage stability of the toner can be improved.

Further, when TgA and Z(25) described above satisfy the above relationships, the adhesive force of the binder resin with a transfer material at the time of the heating and pressurization of the toner can be additionally improved. Accordingly, the low-temperature fixability of the toner can be improved.

The microscopic compression test on the toner in the present invention is performed by applying a small load up to $2.94\times10^{-4}$ N to one particle of the toner so that a hardness and a recovery ratio near the surface of the toner are mainly observed.

The toner of the present invention has the following characteristic: when, in a load-displacement curve obtained by plotting a load and a displacement in the microscopic compression test on the toner at a measurement temperature of 25° C., the gradient of the load-displacement curve from the origin to the maximum load is represented by R(25), R(25) satisfies the relationship of $0.49\times10^{-3}\leqq R(25)\leqq1.70\times10^{-3}$.

That is, R(25) in the toner of the present invention is an indication of the hardness near the surface layer of the toner at a temperature of 25° C. When R(25) is less than $0.49\times10^{-3}$ N/μm, the toner is apt to collapse or deform owing to a stress which the toner receives in a developing assembly, so the developing performance and transferring performance of the toner are apt to reduce.

In contrast, when R(25) exceeds $1.70\times10^{-3}$ N/μm, the vicinity of the surface layer of the toner becomes not only hard but also brittle, so the toner may chip owing to a trace load. As a result, the durability of the toner reduces, and the low-temperature fixability or image gloss of the toner is apt to reduce.

In addition, the toner of the present invention has the following characteristic: in the case where, in the microscopic compression test on the toner at a measurement temperature of Y° C., a displacement (μm) obtained upon completion of the application of a maximum load of $2.94\times10^{-4}$ N to one particle of the toner at a loading rate of $9.8\times10^{-5}$ N/sec is defined as a displacement $X_{2(Y)}$, a displacement (μm) obtained when the particle is left to stand for 0.1 second at the maximum load after the completion of the application of the maximum load is defined as a maximum displacement $X_{3(Y)}$, a displacement (μm) obtained when the load is unloaded at an unloading rate of $9.8\times10^{-5}$ N/sec to reach zero after the standing for 0.1 second is defined as a displacement $X_{4(Y)}$, a difference between the maximum displacement $X_{3(Y)}$ and the displacement $X_{4(Y)}$ is defined as an elastic displacement $(X_{3(Y)}-X_{4(Y)})$, and a percentage $[\{(X_{3(Y)}-X_{4(Y)}/X_{3(Y)}\}\times100$: recovery ratio] of the elastic displacement $(X_{3(Y)}-X_{4(Y)})$ to the maximum displacement $X_{3(Y)}$ is represented by Z(Y) (%), Z(25) when the measurement temperature Y is 25° C. satisfies the relationship of $40\leqq Z(25)\leqq80$.

Z(25) represents the extent to which the surface layer of the toner returns to its original state when the load is unloaded after the application of the maximum load at a measurement temperature of 25° C. When Z(25) is less than 40, the toner is apt to deform owing to a stress which the toner receives in a developing assembly, so the developing performance and transferring performance of the toner are apt to reduce. In addition, the vicinity of the surface layer of the toner becomes excessively soft, so the adhesion of each toner particle to a fixing roller at the time of a fixing step becomes strong. As a result, the toner is apt to migrate to the surface of the fixing roller, so the hot offset resistance of the toner is apt to reduce. On the other hand, when Z(25) exceeds 80, the vicinity of the surface layer of the toner becomes excessively hard, so the toner hardly deforms. As a result, the bleeding performance of the wax component in the fixing step reduces, so cold offset is apt to occur, in other words, such value is unqualified for low-temperature fixability. In addition, the image gloss of the toner is apt to reduce. In addition, the surface of each toner particle hardly deforms, so an external additive hardly adheres to the surface of the toner particle. As a result, the following tendency is observed: when images are printed out on a large number of sheets, the external additive on the surface of the toner is apt to be liberated, and the developing performance or the transferring performance reduces. Further, Z(25) is more preferably 45 or more and 70 or less from the viewpoint of low-temperature fixability.

Further, the toner of the present invention preferably has the following characteristics for achieving compatibility between durability and fixing performance: the average of $X_{2(25)}$'s is 0.20 μm or more and 0.60 μm or less, while the average of $X_{3(25)}$'s is 0.22 μm or more and 0.65 μm or less.

A toner satisfying such specifications of R(25) and Z (25) as described above is a toner having the following characteristics: the vicinity of the surface of each toner particle is relatively hard, and the inside of each toner particle is soft. A toner particle having a core-shell structure is suitable for obtaining such toner.

R(25) and Z(25) described above can be caused to satisfy the above relationships by employing any one of the approaches including, but not limited to, the following approach.

(1) When the toner particles are produced in an aqueous dispersion medium, a polar resin to be described later is incorporated into each of the toner particles so that a shell layer is formed of the resin. Further, the polar resin is selected in consideration of compatibility with the binder resin of which a core portion is formed.

(2) After the core particles of the toner particles have been produced in the aqueous dispersion medium, a monomer of which the polar resin is constituted is added and subjected to seed polymerization, whereby the shell layer is formed.

(3) Polar resin fine particles having a volume average particle diameter smaller than that of the core particles are mechanically caused to adhere to the core particles. Alternatively, the polar resin fine particles having a small volume average particle diameter are caused to adhere to the core particles by agglomeration, and are fixed by heating in the aqueous dispersion medium.

In addition, Z(50) when the measurement temperature Y in the microscopic compression test on the toner of the present invention is 50° C. preferably satisfies the relationship of $10\leqq Z(50)\leqq55$. When Z(50) falls within the above range, the toner can exert high bleeding performance even with instantaneous heat in a fixing step, and its low-temperature fixability can be additionally improved. In addition, Z(50) described above preferably satisfies the relationship of $20\leqq Z(50)\leqq50$, or more preferably satisfies the relationship of $30\leqq Z(50)\leqq50$.

Further, the toner of the present invention preferably has the following characteristics for achieving compatibility between durability and fixing performance: $X_{2(50)}$ is 0.05 μm or more and 0.45 μm or less, and $X_{3(50)}$ is 0.10 μm or more and 0.50 μm or less.

Z(50) described above can be caused to satisfy the above range by adjusting, for example, the glass transition temperature or weight-average molecular weight of the polar resin or of the binder resin of the toner, or the addition amount of a crosslinking agent.

Next, a measurement method for the microscopic compression test will be described with reference to FIG. 1.

FIG. 1 shows a profile (load-displacement curve) upon measurement for the toner of the present invention by the microscopic compression test. The axis of abscissa indicates the displacement by which the toner deforms, and the axis of ordinate indicates a load applied to the toner.

An ultra-micro hardness meter ENT1100 manufactured by ELIONIX CO., LTD. was used in the microscopic compression test in the present invention. A flat indenter having a tip surface measuring 20 μm by 20 μm was used as an indenter in the measurement. Reference numeral 1-1 in the figure represents an initial state (origin) before the initiation of the test. A load is applied at a loading rate of $9.8\times10^{-5}$ N/sec to reach a maximum load of $2.94\times10^{-4}$ N. After the load has reached the maximum load, a state 1-2 is established. When the measurement temperature is 25° C., a displacement in this state is represented by $X_{2(25)}$(μm) The toner is left to stand in the state 1-2 for 0.1 second at the load. Reference numeral 1-3 represents a state immediately after the completion of the standing, and a maximum displacement in the state is represented by $X_{3(25)}$ (μm). Further, the load is reduced from the maximum load at an unloading rate of $9.8\times10^{-5}$ N/sec, and the time point at which the load reaches 0 N corresponds to a state 1-4. A displacement in this state is represented by $X_{4(25)}$ (μm).

The [gradient of the load-displacement curve] R(25) from the origin to the maximum load was calculated as follows: the load-displacement curve from the state 1-1 to the state 1-2 was approximated to be a first-order straight line, and the gradient of the straight line was calculated as [$2.94\times10^{-4}$/displacement $X_{2(25)}$] (N/μm). In addition, Z (25) representing a percentage (hereinafter also referred to as "recovery ratio (%)") of the elastic displacement ($X_{3(25)}-X_{4(25)}$) to the maximum displacement $X_{3(25)}$ was calculated as $\{(X_{3(25)}-X_{4(25)})/X_{3(25)}\}\times100$. Further, Z(50) is a value determined from the maximum displacement $X_{3(50)}$ and the displacement $X_{4(50)}$ obtained by the same method as the method of measuring Z(25) described above except that the measurement is performed at a measurement temperature of 50° C. in the microscopic compression test on the toner.

In actuality, the measurement is performed as follows: the toner is applied onto a ceramic cell, air is blown so that the toner may be dispersed onto the ceramic cell, and then the ceramic cell is set in the ultra-micro hardness meter.

In addition, upon measurement, the ceramic cell was brought into such a state that the temperature of the cell could be controlled, and the temperature of the ceramic cell was defined as a measurement temperature. That is, R(25) and Z (25) were measured by setting the temperature of the cell to 25° C., and R(50) was measured by setting the temperature of the cell to 50° C. It should be noted that the temperature of the ceramic cell was adjusted as follows: the ceramic cell was placed in the ultra-micro hardness meter, the ceramic cell was left to stand for 10 minutes or longer after its temperature had reached the measurement temperature, and then the measurement was initiated.

The measurement was performed as follows: a toner present as one particle in a screen for measurement (breadth: 160 μm, length: 120 μm) was selected with a microscope included with the ultra-micro hardness meter. A toner particle having a particle diameter in the range of the number average particle diameter D1of the toner±0.2 μm was selected for the measurement in order that an error about a displacement might be eliminated to the extent possible. An arbitrary toner may be selected from the screen for measurement as long as the toner satisfies the above relationship. The particle diameter of a toner on the screen for measurement was measured by the following method: software included with the ultra-micro hardness meter ENT1100 was used for measuring the longer diameter and shorter diameter of a toner particle, and a toner having an aspect ratio [(longer diameter+shorter diameter)/2] determined from the diameters in the range of D1±0.2 μm was selected for the measurement.

Measurement data was processed as described below. 100 arbitrary particles were selected for the measurement so that 100 values were determined for each of Z(25), Z(50), and R(25). Ten highest values and ten lowest values were eliminated from the 100 values for each of Z(25), Z(50), and R(25), and the remaining 80 values were used as data. The arithmetical mean of the 80 values was determined and used as each of Z(25), Z(50), and R(25).

In addition, a method of measuring the number average particle diameter (D1) of the toner is as described below.

Measurement was conducted with a Coulter Multisizer (manufactured by Beckman Coulter, Inc.) connected to an interface (manufactured by Nikkaki Bios Co., Ltd.) and a PC9801 personal computer (manufactured by NEC Corporation) for outputting a number distribution and a volume distribution in accordance with the instruction manual of the device.

Specifically, a 1% aqueous solution of NaCl is prepared as an electrolyte solution with extra-pure sodium chloride. For example, an ISOTON R-II (manufactured by Coulter Scientific Japan, Co.) can be used. 20 mg of a measurement sample (toner) is added to 150 ml of the electrolyte aqueous solution. The electrolyte solution into which the sample has been suspended is subjected to a dispersion treatment by using an ultrasonic dispersing device for 3 minutes. The volume and number of toner particles each having a diameter of 2.0 μm or more are measured with the Coulter Multisizer by using a 100-μm aperture to determine weight average particle size (D1).

In the present invention, R(25) and Z(25) must satisfy the above-mentioned relationships, and the toner must have a glass transition temperature (TgA) measured with a differential scanning calorimeter (DSC) of 40° C. or higher and 60° C. or lower, or preferably 40° C. or higher and 55° C. or lower in order that the toner may achieve good fixing performance. In addition, the toner has a peak temperature (P1) of the highest endothermic peak measured with the differential scanning calorimeter (DSC) of 70° C. or higher and 110° C. or lower, preferably 70° C. or higher and 90° C. or lower, or more preferably 70° C. or higher and 85° C. or lower.

When TgA described above is 40° C. or higher and 60° C. or lower, the adhesive force of the toner with paper in fixation at low temperatures is improved, so the low-temperature fixability of the toner is improved. Meanwhile, when P1described above is 70° C. or higher and 110° C. or lower, the wax component has moderate bleeding performance, so the winding resistance of the toner at high temperatures is improved. Further, the adhesive force with paper is improved by a plasticizing effect of the wax component on the toner, whereby the low-temperature fixability is improved.

Further, P1and TgA satisfy the relationship of 15° C.≦(P1−TgA)≦70° C., preferably satisfy the relationship of 15° C.≦(P1−TgA)≦50° C., or more preferably satisfy the relationship of 15° C.≦(P1−TgA)≦40° C. When (P1−TgA) is 15° C. or more and 70° C. or less, the bleeding performance of the wax component to the surface of the toner at the time of the heating and pressurization of the toner is optimized, whereby the winding resistance is improved. Further, the adhesive force with paper is improved, whereby the low-temperature fixability is improved. In addition, an adverse effect on the durability of the toner can be suppressed.

P1, TgA, and (P1−TgA) described above can be caused to satisfy the above ranges by adjusting, for example, the glass transition temperature of the binder resin of the toner, or the temperature of the highest endothermic peak of the wax component.

In addition, in the toner of the present invention, it is also preferable that each toner particle contain a polar resin. Further, the polar resin has a glass transition temperature (TgB) measured with a differential scanning calorimeter (DSC) of preferably 80° C. or higher and 120° C. or lower, or more preferably 80° C. or higher and 105° C. or lower. Setting TgB within the range can achieve compatibility between the durability and low-temperature fixability of the toner to an additionally large extent. When TgB in the toner of the present invention is lower than 80° C., the durability of the toner tends to reduce. When TgB exceeds 120° C., the low-temperature fixability tends to reduce.

When the toner particles to be used in the present invention are produced by a suspension polymerization method, the polar resin is preferably added at the time of a polymerization reaction ranging from a dispersing step to a polymerizing step. In that case, the state of presence of the polar resin can be controlled in accordance with a polarity balance between a polymerizable monomer composition to serve as each toner particle and an aqueous dispersion medium. That is, a thin-layer shell of the polar resin can be formed on the surface of each toner particle, or the polar resin can be caused to exist with a concentration gradient from the surface of each toner particle to the center of the particle. In addition, the addition of the polar resin allows one to control the strength of the shell portion of the core-shell structure of each particle freely. As a result, the durability and fixing performance of the toner can be optimized.

The polar resin is added in an amount of preferably 1 part by mass or more and 30 parts by mass or less, or more preferably 15 parts by mass or more and 30 parts by mass or less with respect to 100 parts by mass of the binder resin. When the amount is less than 1 part by mass, the state of presence of the polar resin in each toner particle is apt to be nonuniform, and the triboelectric charge distribution of the toner is apt to be broad. On the other hand, when the amount exceeds 30 parts by mass, a thin layer of the polar resin to be formed on the surface of each toner particle becomes thick, so the fixing performance of the toner is apt to reduce.

Specific examples of the polar resin to be used in the present invention include a polyester resin, an epoxy resin, a styrene-acrylic acid copolymer, a styrene-methacrylic acid copolymer, and a styrene-maleic acid copolymer. A polar resin having a carboxyl group is also preferable. A styrene-methacrylic acid copolymer or styrene-acrylic acid copolymer having a peak molecular weight of 3,000 or more and 50,000 or less is particularly preferably used as the polar resin because its addition amount at the time of the production of the toner can be freely controlled. In addition, the toner is preferably produced by suspension polymerization using a styrene-methacrylic acid copolymer or a styrene-acrylic acid copolymer as the polar resin and a vinyl-based polymerizable monomer because compatibility between the polar resin and the binder resin of the toner becomes additionally favorable. As a result, the polar resin tends to exist with a concentration gradient from the surface of each toner particle to the center of the particle, adhesiveness between the core portion and the shell layer is improved, and the durability of the toner is improved.

As described above, the toner of the present invention has, for example, the following preferable properties: a core-shell structure is formed in each toner particle, adhesiveness between the core portion and the shell layer is improved, the toughness of the toner against an external factor at the time of the pressurization of the toner is large at normal temperature, and a core component (especially the wax component) has bleeding performance at the time of the heating of the toner. Those properties of the toner particles may contribute to improvements in developing property, transferring property, fixing property, and storage stability of the toner.

The toner of the present invention is characterized by satisfying the relationships of 40≦Z(25)≦80 and 15° C.≦(P1−TgA)≦70° C. Of the conventional toners, a toner in which Z(25) is high tends to be such that P1−TgA is small. In order that a toner having additionally high cold offset resistance may be obtained, P1−TgA must be increased while TgA is lowered. However, lowering TgA inevitably lowers Z(25), with the result that a good toner cannot be obtained. As described above, it has been difficult to produce a toner in which both Z(25) and P1−TgA are high. In the present invention, for example, any one of the following approaches is effective in producing a toner satisfying the relationships of 40≦Z(25)≦80 and 15° C.≦(P1−TgA)≦70° C.: a styrene-acrylic resin is used as the polar resin to be used in the shell layer of each toner particle, a polar resin having a low Tg is used, or the amount in which the polar resin is added is increased. A toner satisfying the above conditions is excellent in low-temperature fixability and hot offset property.

The binder resin to be incorporated into the toner of the present invention preferably contains 0.0050 to 0.025 mass % of divinylbenzene. The incorporation of divinylbenzene crosslinks the core portions to cause the wax component to bleed moderately. As a result, a toner having high offset resistance can be obtained.

Further, the toner of the present invention can obtain an additionally high effect by satisfying the relationships of 30≦Z(50)≦50 and 45≦Z(25)≦70. That is, such constitution as described above can provide a toner having high durability and high blocking resistance while maintaining its low-temperature fixability. The incorporation of 0.015 to 0.025 mass % of divinylbenzene into the binder resin is effective in producing a toner having such nature as described above. As long as the content of divinylbenzene falls within about the above range, the elasticity of each core portion can be improved while the low Tg of the core portion is maintained, whereby the above effect becomes additionally significant.

It should be noted that the content of divinylbenzene in the present invention is calculated as the amount of a unit derived from divinylbenzene.

TgA, TgB, and P1described above were each measured with a differential scanning calorimeter (DSC) "Q1000" (manufactured by TA Instruments Japan) in conformity with ASTM D3418-82 by the following method under the following conditions.

<Measurement Conditions and Method>

(1) Use modulated mode.

(2) Equilibrium is kept at a temperature of 20° C. for 5 minutes.

(3) A modulation of 1.0° C./min is used so that the temperature of the toner is increased to 140° C. at 1° C./min.

(4) Equilibrium is kept at a temperature of 140° C. for 5 minutes.

(5) The temperature is reduced to a temperature of 20° C.

About 3 mg of a measurement sample are precisely weighed. The sample is loaded into an aluminum pan, and is subjected to measurement in the measurement temperature range of 20 to 140° C. at a rate of temperature increase of 1° C./min by using an empty aluminum pan as a reference.

The glass transition temperature (Tg) as used herein is determined by a middle point method. In addition, the peak temperature (P1) of the highest endothermic peak of the toner is the temperature at which an endothermic peak shows a local maximum. When multiple endothermic peaks are present, an endothermic peak having the highest height from a base line in a region above the endothermic peaks is defined as the highest endothermic peak.

The toner of the present invention has a viscosity at a temperature of 100° C. by a flow tester heating method (which may hereinafter be referred to as "melt viscosity") of preferably $0.3\times10^4$ Pa·s or more and $2.0\times10^4$ Pa·s or less, or more preferably $0.3\times10^4$ Pa·s or more and $1.5\times10^4$ Pa·s or less. When the melt viscosity of the toner is $0.3\times10^4$ Pa·s or more and $2.0\times10^4$ Pa·s or less, the winding resistance of the toner is improved by moderate bleeding performance of the wax component. Further, the adhesive force of the toner with paper is improved, so the low-temperature fixability of the toner is improved.

The above melt viscosity is set to be relatively low. In the toner of the present invention, R(25) and Z(25) satisfy the above ranges, and the core-shell structure is formed. In addition, adhesiveness between the core portion and the shell layer is high, whereby a reduction in durability or storage stability of the toner which may generally occur owing to a low melt viscosity hardly occurs.

The melt viscosity can be caused to satisfy the above range by adjusting, for example, the glass transition temperature or weight-average molecular weight of the polar resin or of the binder resin, and, furthermore, the kind of the wax component.

The above melt viscosity of the toner was measured by the following method.

The melt viscosity of the toner in the present invention is the viscosity of the toner at a temperature of 100° C. measured by a flow tester heating method as described above. Measurement is performed with a Flow Tester CFT-500D (manufactured by Shimadzu Corporation) under the following conditions, in accordance with the instruction manual of the device.

| | |
|---|---|
| Sample: | about 1.1 g of the toner are weighed, and are molded into a sample with a pressure molder. |
| Die hole diameter: | 0.5 mm |
| Die length: | 1.0 mm |
| Cylinder pressure: | $9.807\times10^5$ Pa |
| Measurement mode: | Heating method |
| Rate of temperature increase: | 4.0° C./min |

The viscosities (Pa·s) of the toner at temperatures of 50° C. to 200° C. are measured by the above method, and the melt viscosity (Pa·s) of the toner at a temperature of 100° C. is determined.

The toner of the present invention has an average circularity of preferably 0.960 or more and 1.000 or less, or more preferably 0.965 or more and 0.990 or less.

When the average circularity of the toner is 0.960 or more and 1.000 or less, an area of contact between the toner and a photosensitive member is small, and the adhesive force of the toner with the photosensitive member resulting from an image force, van der Waals force, or the like reduces, whereby the toner can obtain high transferring performance. In addition, a toner coat amount in the longitudinal direction of a toner carrying member becomes uniform, so an electrostatic latent image on the photosensitive member can be faithfully developed with the toner. Further, in the case where the toner of the present invention, in which R(25) and Z(25) fall within the above ranges, has an average circularity of 0.960 or more and 1.000 or less, the toner can maintain good transferring performance even when the deterioration of the surface of the toner occurs owing to printout on a large number of sheets.

When the toner is produced by a suspension polymerization method, the above average circularity can be caused to satisfy the above range by (1) controlling a pH in an aqueous dispersion medium at the time of granulation, (2) subjecting the toner to a sphering treatment with heat in the aqueous dispersion medium, or (3) subjecting the toner to a sphering treatment by a mechanical approach.

The average circularity of toner of the present invention is measured with a flow-type particle image analyzer "FPIA-3000 type" (manufactured by SYSMEX CORPORATION) in accordance with the instruction manual of the device.

The measurement principle of the above device is as follows: flowing particles are photographed as a static image, and the image is analyzed. A sample added to a sample chamber is transferred to a flat sheath flow cell with a sample sucking syringe. The sample transferred to the flat sheath flow cell is sandwiched between sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 pixels (each measuring 0.37 μm by 0.37 μm), whereby the border of each particle image is sampled. Then, the projected area, perimeter, and the like of each particle image are measured.

An image signal is subjected to A/D conversion in an image processing portion and captured as image data, and stored image data is subjected to image processing for judging whether a particle is present.

Next, an edge enhancing treatment as a pretreatment for appropriately sampling the edge of each particle image is performed.

Then, image data is binarized at a certain appropriate threshold level.

Figure 4:
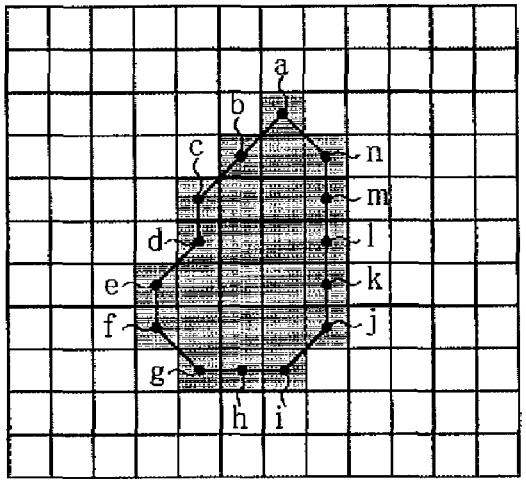
FIG. 4 is a binarized image of image data in a flow-type particle image measuring apparatus.

When image data is binarized at a certain appropriate threshold level, each particle image becomes such binarized image as shown in FIG. 4. Next, judgment as to whether each binarized particle image is an edge point (edge pixel representing an edge) is made, and information about the direction in which an edge point adjacent to the edge point of interest is present, that is, a chain code is prepared.

Next, projected areas S of each measured particle image and the perimeter L of a particle projected image are measured. With the value for area S and perimeter L described above, a circle-equivalent diameter and a circularity are determined. The circle-equivalent diameter C is defined as the diameter of a circle having the same area as that of the projected area of a particle image, the circularity C is defined as a value obtained by dividing the perimeter of a circle determined from the circle-equivalent diameter by the perimeter of a particle projected image, and the circle-equivalent diameter and the circularity are calculated from the following equation.

$$C=2\times(\pi S)^{1/2}/L \quad \text{(Equation)}$$

When a particle image is of a complete round shape, the circularity of the particle in the image becomes 1.000. With an increase in a perimeter unevenness degree of the particle image, the circularity of the particle decreases.

After the circularities of the respective particles have been calculated, the circularities are obtained by dividing a circularity range of 0.200 or more to 1.000 or less into 800 sections. An arithmetic average is calculated by using the central value of each divided points and the number of measured particles so that the average circularity is calculated.

A specific measurement method is as described below. 10 ml of ion-exchanged water from which an impurity solid and the like has been removed in advance are prepared in a container. A surfactant, an alkylbenzene sulfonate, is added as a dispersant to the ion-exchanged water, and, furthermore, 0.02 g of a measurement sample is added to and uniformly dispersed in the mixture. The dispersion treatment is performed for 5 minutes with an ultrasonic dispersing unit UH-50 model (manufactured by SMT) mounted with a titanium alloy tip having a diameter of 5 mm as an oscillator, whereby a dispersion liquid for measurement is obtained. At that time, the dispersion liquid is appropriately cooled so as not to have a temperature of 40° C. or higher. The above flow-type particle image analyzer mounted with a standard objective lens (at a magnification of 10) was used for measurement, and a particle sheath "PSE-900A" (manufactured by SYSMEX CORPORATION) was used as a sheath liquid. The dispersion liquid prepared in accordance with the above procedure was introduced into the flow-type particle image analyzer, and 3,000 toner particles were measured according to a total count mode using a HPF measurement mode. The average circularity of the toner was determined by setting a binarization threshold to 85% and limiting particle diameters to be analyzed to ones each corresponding to a circle-equivalent diameter of 2.00 μm or more to 200.00 μm or less upon the particle analysis.

Prior to the initiation of the measurement, automatic focusing is performed by using standard latex particles (obtained by diluting, for example, 5200A manufactured by Duke Scientific with ion-exchanged water). After that, focusing is preferably performed every two hours from the initiation of the measurement.

It should be noted that, in each example of the present application, a flow-type particle image analyzer which had received a calibration certificate issued by SYSMEX CORPORATION was used, and the measurement was performed under measurement and analysis conditions identical to those at the time of the reception of the calibration certificate except that particle diameters to be analyzed were limited to ones each corresponding to a circle-equivalent diameter of 2.00 μm or more and 200.00 μm or less.

Examples of wax components which may be used in the present invention preferably includes: petroleum waxes such as a paraffin wax, a microcrystalline wax, and petrolactam, and derivatives thereof; a montan wax and derivatives thereof; a hydrocarbon wax according to a Fischer-Tropsch method and derivatives thereof; polyolefin waxes such as a polyethylene wax and polypropylene wax, and derivatives thereof; natural waxes such as a carnauba wax and a candelilla wax, and derivatives thereof; higher aliphatic alcohols; fatty acids such as stearic acid, and palmitic acid; acid amide waxes; ester waxes; cured castor oils and derivatives thereof; plant waxes; and animal waxes.

Examples of the above derivatives include an oxide, a block copolymer with a vinyl-based monomer, and a graft denatured product.

Of those, an ester wax and a hydrocarbon wax are particularly preferable because each of the waxes is excellent in releasing performance. Further, in the toner of the present invention, a hydrocarbon wax is more preferably used in order that the core-shell structure may be easily controlled, and an effect of the present invention may be easily exerted.

The content of the above wax component is preferably 4 parts by mass or more and 25 parts by mass or less with respect to 100 parts by mass of the binder resin. When the content of the wax component is 4 parts by mass or more and 25 parts by mass or less, the wax component can show moderate bleeding performance at the time of the heating and pressurization of the toner, whereby the winding resistance of the toner is improved. Further, the extent to which the wax component is exposed to the surface of the toner owing to a stress which the toner receives at the time of development or transfer is reduced, so each toner particle can obtain uniform triboelectric charging performance.

In the present invention, macromolecules each having a sulfonic group, a sulfonate group, or a sulfonic acid ester group at any one of its side chains are each preferably used in each toner particle mainly for the control of the charge of the toner or the stabilization of granulation in an aqueous dispersion medium. Of those, a polymer or copolymer having a sulfonic group, a sulfonate group, or a sulfonic acid ester group is particularly preferably used. Any such macromolecule as described above is preferably added in an amount of 0.1 part by mass or more and 3 parts by mass or less with respect to 100 parts by mass of the binder resin.

When the toner of the present invention is produced by a suspension polymerization method, the addition of the above polymer or copolymer having a sulfonic group, a sulfonate group, or a sulfonic acid ester group promotes the formation of the core-shell structure of each toner particle at a polymerization stage as well as the stabilization of granulation. As a result, compatibility between the durability and fixing performance of the toner can be achieved to an additionally large extent.

Examples of the monomer having a sulfonic group, a sulfonate group, or a sulfonic acid ester group for producing the polymer or copolymer include styrene sulfonic acid, 2-acrylamide-2-methylpropane sulfonic acid, 2-methacrylamide-2-methylpropane sulfonic acid, vinyl sulfonic acid, or methacryl sulfonic acid and alkylesters thereof.

The polymer or copolymer containing a sulfonic group, a sulfonate group, or a sulfonic acid ester group to be used in the present invention may be a homopolymer of any such monomer as described above, or may be a copolymer of any such monomer as described above and any other monomer. A monomer that forms a copolymer with any such monomer as described above is a vinyl-based polymerizable monomer, and a monofunctional polymerizable monomer or a polyfunctional polymerizable monomer can be used.

Examples of the binder resin to be used in the present invention include a styrene-acrylic copolymer, a styrene-methacrylic copolymer, an epoxy resin, and a styrene-butadiene copolymer. The polymerizable monomer to be used in the production of the above binder resin is, for example, a vinyl-based polymerizable monomer capable of radical polymerization. A monofunctional polymerizable monomer or polyfunctional polymerizable monomer can be used as the vinyl-based polymerizable monomer.

As the vinyl-based polymerizable monomer, the followings are exemplified: styrene; styrene-based monomers such as o- (m-, p-)methylstyrene and m- (p-) ethylstyrene; acrylate-based monomers or methacylate-based monomers such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate, and diethylaminoethyl methacrylate; ene-based monomers such as butadiene, isoprene, cyclohexene, acrylonitrile, methacrylonitrile, acrylic acid amide, and methacrylic acid amide.

Although each of those monomers may be used alone, two or more of them are generally mixed in an appropriate fashion before use with reference to a theoretical glass transition temperature (Tg) described in the publication Polymer Handbook, 2nd edition, III, p 139 to 192 (published by John Wiley & Sons).

In addition, a low-molecular weight polymer can be added upon production of the toner of the present invention in order that the toner of the present invention may have a preferable molecular weight distribution. When the toner is produced by a pulverization method, the low-molecular weight polymer can be added upon melting and kneading with the binder resin and the like. Alternatively, when the toner is produced by a suspension polymerization method, the polymer can be added to a polymerizable monomer composition. A polymer having a weight average molecular weight (Mw) measured by gel permeation chromatography (GPC) in the range of 2,000 or more to 5,000 or less and a ratio Mw/Mn of less than 4.5, or more preferably less than 3.0 is preferably used as the low-molecular weight polymer.

Examples of the low-molecular weight polymer include a low-molecular weight polystyrene, a low-molecular weight styrene-acrylate copolymer, and a low-molecular weight styrene-acrylic copolymer.

In the present invention, a crosslinking agent may be used at the time of the synthesis of the binder resin of the toner not only for improving the mechanical strength of each toner particle but also for controlling the molecular weight of the binder resin.

As described above, divinylbenzene is preferably used as the crosslinking agent to be used in the present invention; any such crosslinking agent as described below can also be used.

The following may be given as examples of the bifunctonal cross-linking agent.

Bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylates (MANDA, Nippon Kayaku Co., Ltd.), and those obtained by changing the above diacylates to dimethacrylates.

The following may be given as examples of the polyfunctional cross-linking agent.

Pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxypolyethoxyphenyl)propane, diallylphthalate, triallylcyanurate, triallylisocyanurate, and triallyltrimelitate.

An amount of those cross-linking agents to be added is preferably 0.0050 parts by mass or more and 0.050 parts by mass or less, more preferably 0.0050 parts by mass or more and 0.025 parts by mass or less with respect to 100 parts by mass of the polymerizable monomer.

The following may be given as examples of the polymerization initiator to be used in the present invention.

Azo type or diazo type polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and the peroxide-based polymerization initiator such as benzoylperoxide, methylethylketoneperoxide, diisopropylperoxycarbonate, cumene hydroperoxide, 2,4-dichlorobenzoylperoxide, lauroylperoxide, and tert-butyl-peroxypivalate.

The usage of each of those polymerization initiators, which varies depending on the target degree of polymerization, is generally 3 parts by mass or more and 20 parts by mass or less with respect to 100 parts by mass of the polymerizable monomer. The number of kinds of polymerization initiators to be used varies slightly depending on a polymerization method. One kind of the polymerization initiators may be used alone, or two or more kinds of them may be used as a mixture with reference to a 10-hour half-life temperature.

Examples of the colorant to be preferably used in the present invention include the following organic pigments, dyes, or inorganic pigments.

For the organic pigment or the organic dye as a cyan type colorant, a copper phthalocyanine compound and derivatives thereof, an anthraquinone compound, a lake compound of basic dyes, and the like may be used.

Specific examples thereof include the following. C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of the organic pigment or the organic dye as a magenta type colorant include the following.

A condensed azo compound, a diketopyrrolopyrrole compound, anthraquinone, a quinacridone compound, a lake compound of basic dyes, a naphthol compound, a benzimidazolone compound, a thioindigo compound, a perylene compound, and the like.

Specific examples include the following. C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

For the organic pigment or the organic dye as a yellow type colorant, the compound represented by a condensed azo compound, an isoindolinone compound, an anthraquinone compound, azo metallic complexes, a methine compound, or an allylamide compound may be used.

Specific examples include the following. C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

A black colorant to be used is carbon black and a colorant toned to have a black color by using the above yellow-based/magenta-based/cyan-based colorants.

One kind of those colorants can be used alone, or two or more kinds of them can be used as a mixture. Furthermore, each of those colorants can be used in a solid solution state. The colorant to be used in the toner of the present invention is selected in terms of hue angle, chroma, brightness, light resistance, OHP transparency, and dispersibility into the toner.

The amount of the colorant to be added is preferably 1 part by mass or more and 20 parts by mass or less with respect to 100 parts by mass of the binder resin.

In the toner of the present invention, each toner particle can be mixed with a charge control agent as required before use. Blending the charge control agent can stabilize charging property and can control an optimum triboelectric charge amount in accordance with a developing system.

A known agent can be used as the charge control agent. In particular, a charge control agent having a high triboelectric charging speed and capable of stably maintaining a constant triboelectric charge amount is preferable. Furthermore, when toner is directly produced by means of a polymerization method, a charge control agent having low polymerization inhibiting property and substantially free of any matter soluble in an aqueous dispersion medium is particularly preferable.

The organic metal compound and the chelate compound are exemplified as a charge control agent for controlling a toner to negative charge. Examples of the charge control agent include a monoazo metal compound, an acetylacetone metal compound, a metal compound of aromatic oxycarbonate, aromatic dicarbonate, oxycarbonate, or dicarbonate. Examples of the other charge control agents include: aromatic oxycarbonate, aromatic monocarbonate and aromatic polycarbonate anhydride and esters thereof; and phenol derivatives such as bisphenol. In addition, examples of the charge control agent also include urea derivatives, a metal-containing naphthoic acid compound, aboric compound, quaternary ammonium salts, calixarene, a resin type charge control agent.

On the other hand, examples of a charge control agent for controlling a toner to positive charge include the following. Nigrosine and nigrosine-modified products modified by aliphatic metal salts; a guanidine compound; an imidazole compound; quaternary ammonium salts such as tributylbenzylammonium-1-hydroxy-4-naphthosulfonic acid salts and tetrabutylammonium tetrafluoroborate, onium salts such as a phosphonium salt which are analogs thereof, and a lake pigment thereof; a triphenylmethane dye and a lake pigment thereof (examples of a laking agent include phosphorus tungstate, phosphorus molybdate, phosphorus tungstemolybdate, tannin acid, lauric acid, gallic acid, ferricyanide, ferrocyanide); metal salts of higher fatty acids; and resin type charge control agents.

The toner of the present invention can contain one kind of those charge control agents alone, or can contain two or more kinds of them in combination.

Of those charge control agents, a metal-containing salicylic acid-based compound is preferable. In particular, the metal is preferably aluminum or zirconium. The most preferable charge control agent is an aluminum 3,5-di-tert-butylsalicylate compound.

The loading of the charge control agent is preferably 0.01 parts by mass or more and 20 parts by mass or less, or more preferably 0.5 parts by mass or more and 10 parts by mass or less with respect to 100 parts by mass of the binder resin. However, the addition of a charge control agent is not essential to the toner of the present invention. The active utilization of triboelectric charging between a member for regulating the thickness of the toner and a toner carrier eliminates the need for adding a charge control agent to the toner.

An inorganic fine powder is externally added to improve the flowability of the toner of the present invention.

The inorganic fine powder to be externally added to the toner particles of the present invention preferably contains at least a silica fine powder. The silica fine powder preferably has a number average primary particle diameter of 4 nm or more and 80 nm or less. In the present invention, when the number average primary particle diameter falls within the above range, the flowability of the toner is improved, and the storage stability of the toner becomes favorable.

The number average primary particle diameter of the above inorganic fine powder is measured as described below.

An average particle diameter determined by measuring the particle diameters of 100 particles of the inorganic fine powder in a field of view upon observation with a scanning electron microscope is the number average primary particle diameter.

In addition, the silica fine powder and a fine powder made of titanium oxide, alumina, or a double oxide of them can be used in combination as the inorganic fine powder. Titanium oxide is a preferable inorganic fine powder to be used in combination.

Examples of the silica fine powder include: a fine powders of dry silica produced by the vapor phase oxidation of a silicon halide or dry silica referred to as fumed silica; and a fine powders of wet silica produced from water glass. As the silica, the dry silica is preferable because it has a small amount of silanol groups on its surface and in the silica and produces a small amount of a production residue such as $Na_2O$ or $SO_3^{2-}$. In addition, a composite fine powder of the dry silica and any other metal oxide can be obtained by using a metal halogen compound such as aluminum chloride or titanium chloride in combination with a silicon halogen compound in a production step, and such composite fine powder is also included in the scope of the silica.

The inorganic fine powder is added for improving the fluidity of the toner and for uniformizing the triboelectric charging of toner particles. An inorganic fine powder subjected to a hydrophobic treatment is preferably used because subjecting the inorganic fine powder to a treatment such as a hydrophobic treatment can impart functions of, for example, adjusting the triboelectric charge amount of the toner, improving environmental stability, and improving properties in a high-humidity environment to the inorganic fine powder. When the inorganic fine powder added to the toner absorbs moisture, the triboelectric charge amount of the toner reduces, so reductions in developability and transferability are apt to occur.

Examples of a treatment agent for the hydrophobic treatment of the inorganic fine powder include the following.

Undenatured silicone varnishes, various denatured silicone varnishes, undenatured silicone oils, various denatured silicone oils, silane compounds, silane coupling agents, other organic silicon compounds, and organic titanium compounds. One kinds of those treatment agents may be used alone, or two or more kinds of them may be used in combination.

An inorganic fine powder treated with a silicone oil out of those treatment agents is preferable. An inorganic fine powder subjected to a treatment with a silicone oil and a hydrophobic treatment obtained by: subjecting an inorganic fine powder to a hydrophobic treatment with a coupling agent; and treating the inorganic fine powder with a silicone oil simultaneously with or after the inorganic fine powder is hydrophobic treated with the coupling agent is more preferable for maintaining a high triboelectric charge amount of each toner particle even in a high-humidity environment and for reducing selective developability.

When the toner is obtained by employing a polymerization method in the present invention, attention must be paid to the polymerization-inhibiting performance or aqueous phase-migrating performance of the colorant. Therefore, the colorant is preferably subjected to surface modification such as a hydrophobic treatment with a substance that does not inhibit polymerization. Particular attention should be paid upon use of dye-based colorants and carbon black because most of them each have polymerization-inhibiting performance.

A method of suppressing the polymerization-inhibiting performance of a dye-based colorant is, for example, a method involving polymerizing the polymerizable monomer in the presence of the dye-based colorant in advance; the resultant colored polymer is added to the polymerizable monomer composition.

In addition, carbon black may be subjected to a treatment with a substance that reacts with a surface functional group of carbon black such as polyorganosiloxane as well as a treatment similar to that for the above dye-based colorant.

The toner particles to be used in the present invention, which may be produced by employing any approach, are preferably produced by a production method involving granulation in an aqueous dispersion medium such as a suspension polymerization method, an emulsion polymerization method, or a suspension granulation method. The toner particles are particularly preferably toner particles obtained by: dispersing, in an aqueous dispersion medium, a polymerizable monomer composition containing at least the polymerizable monomer to be used in the production of the binder resin, the colorant, and the wax component; granulating the resultant; and polymerizing the polymerizable monomer.

Hereinafter, a method of producing the toner particles to be used in the present invention will be described by taking a suspension polymerization method suitable in obtaining the toner particles as an example.

The toner particles are produced as described below. The polymerizable monomer to be used in the production of the above binder resin, the colorant, the wax component, and any other additive to be used as required are uniformly dissolved or dispersed with a dispersing machine such as a homogenizer, a ball mill, a colloid mill, or an ultrasonic dispersing machine, and a polymerization initiator is dissolved in the resultant, whereby a polymerizable monomer composition is prepared. Next, the polymerizable monomer composition is suspended in an aqueous dispersion medium containing a dispersant, and is then polymerized, whereby the toner particles are produced. The above polymerization initiator may be added simultaneously with the addition of the other additive to the polymerizable monomer, or may be mixed immediately before the suspension in the aqueous dispersion medium. Alternatively, the polymerizable monomer or the polymerization initiator dissolved in a solvent can be added immediately after granulation, or before the initiation of a polymerization reaction.

Any one of known inorganic and organic dispersants can be used as the dispersant at the time of the preparation of the aqueous dispersion medium.

Specific examples of the inorganic dispersant include the following.

Tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina.

On the other hand, examples of the organic dispersant include the following.

Polyvinyl alcohol, gelatin, methylcellulose, methylhydroxypropylcellulose, ethylcellulose, sodium salts of carboxymethylcellulose, and starch.

A commercially available nonionic, anionic, or cationic surface active agent can be used as a dispersant. Examples of the surface active agent include the following. Sodiumdodecyl sulfate, sodium tetradecyl sulfate, sodium pentadecyl sulfate, sodium octyl sulfate, sodium oleate, sodium laurate, potassium stearate, and calcium oleate.

An inorganic, hardly water-soluble dispersant is preferably used as the dispersant, and a hardly water-soluble, inorganic dispersant which is soluble in an acid is particularly preferably used as the dispersant.

In addition, in the present invention, when an aqueous dispersion medium is prepared by using a hardly water-soluble, inorganic dispersant, the usage of such dispersant is preferably 0.2 parts by mass or more to 2.0 parts by mass or less with respect to 100 parts by mass of a polymerizable monomer. In addition, in the present invention, an aqueous dispersion medium is preferably prepared with water in an amount of 300 parts by mass or more to 3,000 parts by mass or less with respect to 100 parts by mass of a polymerizable monomer composition.

In the present invention, when an aqueous dispersion medium into which the hardly water-soluble, inorganic dispersant as described above is dispersed is prepared, a commercially available dispersant may be dispersed as it is. In addition, in order to obtain dispersant particles each having a fine, uniform grain size, an aqueous dispersion medium may be prepared by producing the hardly water-soluble, inorganic dispersant as described above in a liquid medium such as water under high-speed stirring. For example, when tricalcium phosphate is used as a dispersant, a preferable dispersant can be obtained by mixing an aqueous solution of sodium phosphate and an aqueous solution of calcium chloride under high-speed stirring to form fine particles of tricalcium phosphate.

Next, an example of an image-forming method capable of using the toner of the present invention will be described with reference to FIGS. 2 and 3.

Figure 3:
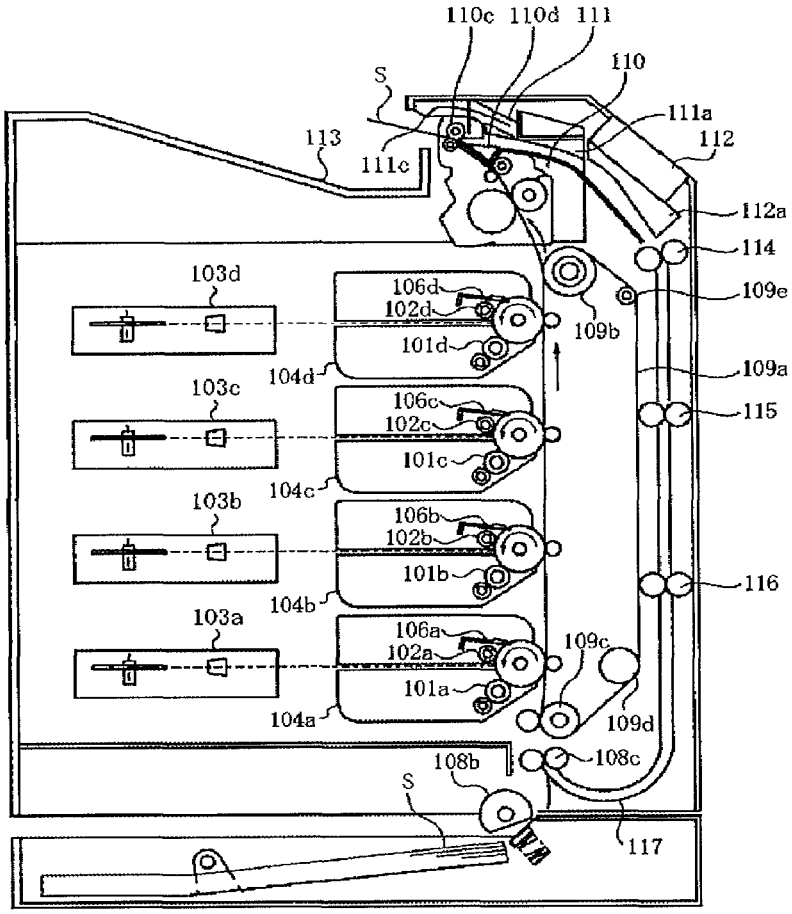
FIG. 3 is a sectional view of an electrophotographic apparatus employing an image-forming method of the present invention.

FIG. 3 illustrates the constitution of an image-forming apparatus including an image-forming method used in the present invention. The image-forming apparatus illustrated in FIG. 3 is a laser beam printer which uses a transfer-type electrophotographic process. In particular, FIG. 3 illustrates a sectional drawing of a tandem color laser printer.

In FIG. 3, reference symbols 110 (101*a* to 101*d*) represent drum type electrophotographic photosensitive members (hereinafter referred to as "photosensitive drums") as latent image bearing members each of which rotates in the direction indicated by an arrow shown in the figure (counterclockwise direction) at a predetermined process speed. The photosensitive drums 101*a*, 101*b*, 101*c*, and 101*d* are responsible for the yellow (Y) component, magenta (M) component, cyan (C) component, and black (Bk) component of a color image, respectively.

Hereinafter, each image-forming apparatus Y, X, C, and Bk are referred to as unit a, unit b, unit c, and unit d, respectively.

The photosensitive drums 101*a* to 101*d* are each rotated by an unshown drum motor (DC servo motor). The respective photosensitive drums 101*a* to 101*d* may be provided with driving sources independent of one another. Note that the rotation of each of the drum motors is controlled by an unshown digital signal processor (DSP), and any other control is performed by an unshown CPU.

In addition, an electrostatic adsorption transport belt 109*a* is tensioned around a driver roller 109*b*, fixed rollers 109*c* and 109*e*, and a tension roller 109*d*, and is rotated in the direction indicated by an arrow shown in the figure by the driver roller 109*b* to adsorb and transport a recording medium S.

Hereinafter, description will be given by taking a unit a (yellow) out of the four colors as an example.

The photosensitive drum 101*a* is uniformly subjected to a primary charging treatment by primary charging means 102*a* during its rotation so as to have predetermined polarity and a predetermined potential. Then, the photosensitive drum 101*a* is exposed to light by laser beam exposing means (hereinafter referred to as "scanner") 103*a*, whereby an electrostatic latent image of image information is formed on the photosensitive drum 101*a*.

Next, the electrostatic latent image is visualized by a developing portion 104*a*, whereby a toner image is formed on the photosensitive drum 101*a*. Similar steps are performed for the other three colors (magenta (M), cyan (C), and black (Bk)).

Next, four color toner images are synchronized by a resist roller 108*c* which stops and transfers the recording medium S, which is transported at a timing adjusted by a sheet feeding roller 108*b*, and at a nip portion between each of the photosensitive drums 101*a* to 101*d* and the electrostatic adsorption transport belt 109*a*, the four color toner images are sequentially transferred onto the recording medium S. In addition, at the same time, a residual adhering substance such as transfer residual toner is removed from the photosensitive drums 101*a* to 101*d* by cleaning means 106*a*, 106*b*, 106*c*, and 106*d* after the toner images have been transferred onto the recording medium S.

The recording medium S onto which the toner images have been transferred from the four photosensitive drums 101*a* to 101*d* is separated from the surface of the electrostatic adsorption transport belt 109*a* at the driver roller 109*b* portion so as to be fed into a fixing unit 110. Then, the toner images are fixed on the recording medium S in the fixing unit 110. After that, the medium is discharged to a discharge tray 113 by a discharge roller 110*c*.

Figure 2:
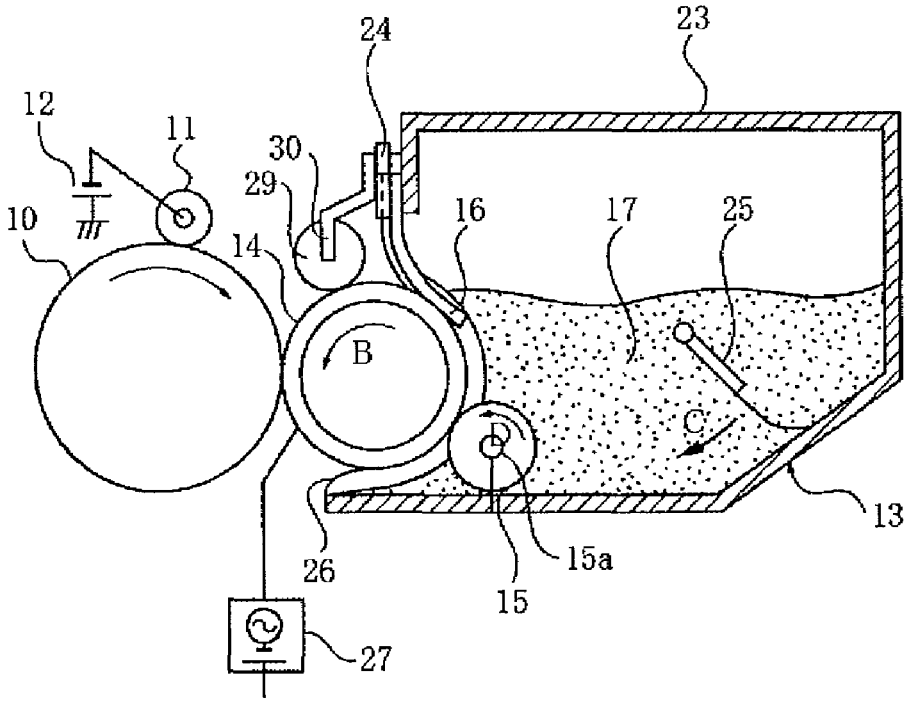
FIG. 2 is an enlarged view of a developing portion of an electrophotographic apparatus.

Next, a specific example of an image-forming method in a non-magnetic, one-component, contact developing system will be described with reference to an enlarged view of a developing portion (FIG. 2). In FIG. 2, a developing unit 13 includes: a developer container 23 storing a non-magnetic toner 17 as a one-component developer; a latent image bearing member (photosensitive drum) 10 positioned at an opening extending in the longitudinal direction in the developer container 23; and a toner carrying member 14 placed so as to develop and visualize the latent image on the latent image bearing member 10. A latent image bearing member contact charging member 11 contacts the latent image bearing member 10. The bias of the latent image bearing member contact charging member 11 is applied by a power supply 12.

The toner carrying member 14 is installed laterally while substantially the right half of its circumferential surface shown in the figure is exposed to the inside of the developer container 23 and substantially the left half of its circumferential surface shown in the figure is exposed to the outside of the developer container 23 at the opening. The surface exposed to the outside of the developer container 23 contacts the latent image bearing member 10 positioned on the left side of the developing unit 13 in FIG. 2 as shown in the figure.

The circumferential speed of the latent image bearing member 10 is 50 to 170 mm/s, and the toner carrying member 14 rotates in the direction indicated by an arrow B at a circumferential speed one time to twice as high as that of the latent image bearing member 10.

A control member 16 is supported by a control member support plate 24 above the toner carrying member 14. The control member uses a metal plate formed of, for example, SUS, a rubber material such as urethane or silicone, or a metal thin plate formed of SUS having spring elasticity or phosphor bronze as a substrate. A rubber material is bonded to the side of the surface of the control member contacting the toner carrying member 14. The control member 16 is provided so that the vicinity of its edge on a free edge side contacts the outer circumferential surface of the toner carrying member 14 by surface contact. The direction in which the vicinity contacts the outer circumferential surface is a counter direction in which the tip side is positioned on the upstream side relative to the contact portion of the direction in which the toner carrying member 14 rotates. An example of the control member 16 is a constitution in which plate-like urethane rubber having a thickness of 1.0 mm is bonded to the control member support plate 24 and the contact pressure (linear pressure) at which the control member contacts the toner carrying member 14 is appropriately set. The contact pressure is preferably 20 to 300 N/m. The contact pressure is measured as follows: three metal thin plates each having a known coefficient of friction are inserted into the portion where the control member and the toner carrying member contact each other, and the value of a force needed for pulling the center plate with a spring balance is converted into the contact pressure. Note that a rubber material is preferably bonded to the surface of the control member 16 contacting the toner carrying member in terms of adhesiveness with toner; the melt adhesion and sticking of the toner to the control member upon long-term use of the toner can be suppressed. In addition, the control member 16 can contact the toner carrying member 14 in an edge contact fashion as described below: an edge of the control member is brought into contact with the toner carrying member. Note that, in the case of the edge contact, the contact angle of the control member 16 relative to the tangent of the toner carrying member at the point where the control member contacts the toner carrying member is preferably set to 40° or less in terms of the control of the thickness of a toner layer.

The toner feeding roller 15 is brought into contact with the upstream side of the direction in which the toner carrying member 14 rotates relative to the portion where the control member 16 contacts the surface of the toner carrying member 14, and the roller is rotatably supported. An effective width at which the toner feeding roller 15 contacts the toner carrying member 14 is 1 to 8 mm, and the toner carrying member 14 is preferably provided with a relative velocity at the portion where the toner feeding roller and the toner carrying member contact each other.

A charging roller 29 is not an essential member for the image-forming method of the present invention, but is preferably provided. The charging roller 29 for a toner carrying member is an elastic body such as an NBR or a silicone rubber, and is attached to a suppressing member 30. In addition, the load under which the charging roller 29 is brought into contact with the toner carrying member 14 by the suppressing member 30 is set to 0.49 to 4.9 N. A toner layer on the toner carrying member 14 is subjected to closest packing, and the upper portion of the toner carrying member is uniformly coated with the toner layer by the contact of the charging roller 29. A longitudinal positional relationship between the control member 16 and the charging roller 29 is preferably such that the charging roller 29 is placed so as to be capable of covering the entire region on the toner carrying member 14 in contact with the control member 16 with reliability.

In addition, it is an absolute necessity for the charging roller 29 to be driven by the toner carrying member 14 or to rotate at the same circumferential speed as that of the member. The presence of a difference in circumferential speed between the charging roller 29 and the toner carrying member 14 is not preferable because the toner carrying member is non-uniformly coated with the toner, and unevenness arises on an image formed with the toner.

The bias of the charging roller 29 is applied by a power supply 27 between both the toner carrying member 14 and the latent image bearing member 10 as a DC voltage (reference symbol 27 in FIG. 2), and the non-magnetic toner 17 on the toner carrying member 14 is provided with charge from the charging roller 29 by discharge.

The bias of the charging roller 29 is a bias equal to or higher than a sparkover voltage identical in polarity to the non-magnetic toner, and is set so that a potential difference of 1,000 to 2,000 V arises between the roller and the toner carrying member 14.

After having been provided with charge by the charging roller 29, the toner layer formed into a thin layer on the toner carrying member 14 is uniformly transported to the developing portion as a portion facing the latent image bearing member 10.

In the developing portion, the toner layer formed into a thin layer on the toner carrying member 14 develops the electrostatic latent image on the latent image bearing member 10 with the aid of the DC bias applied by the power supply 27 shown in FIG. 2 between both the toner carrying member 14 and the latent image bearing member 10 so as to form a toner image.

EXAMPLES

The present invention is described specifically by way of the following examples. A method of producing toner particles is described below. The terms "part (s)" and "%" in all the examples and comparative examples refer to "part(s) by mass" and "mass %", respectively unless otherwise stated.

Example 1

A toner (A) was produced in accordance with the following procedure.

9 parts by mass of tricalcium phosphate and 11 parts by mass of 10% hydrochloric acid were added to 1,300 parts by mass of ion-exchanged water heated to a temperature of 60° C., and the mixture was stirred with a TK-homomixer (manufactured by Tokushu Kika Kogyo) at 10,000 rpm, whereby an aqueous medium having a pH of 5.2 was prepared.

In addition, the following materials were dissolved with a propeller type stirring apparatus at 100 r/min, whereby a solution was prepared.

| | |
|---|---|
| Styrene | 69.0 parts by mass |
| n-butyl acrylate | 31.0 parts by mass |
| Divinylbenzene | 0.023 part by mass |
| Sulfonate group-containing resin (Acryl Base FCA-1001-NS manufactured by FUJIKURA KASEI CO., LTD.) | 2.0 parts by mass |
| Styrene-methacrylic acid-methyl methacrylate-α-methylstyrene copolymer (Styrene/methacrylic acid/methyl methacrylate/α-methylstyrene = 80.85/2.50/1.65/15.0, Mp = 19,700, Mw = 7,900, TgB = 96° C., acid value = 12.0 mgKOH/g, Mw/Mn = 2.1) | 20.0 parts by mass |

Next, the following materials were added to the above solution.

| | |
|---|---|
| C.I. Pigment Blue 15:3 | 7.0 parts by mass |
| Negative charge control agent (BONTRON E-88 manufactured by Orient Chemical Industries, LTD.) | 1.0 part by mass |
| Hydrocarbon wax in which the peak temperature of the highest endothermic peak is 77° C. (HNP-51 manufactured by NIPPON SEIRO CO., LTD.) | 8.0 parts by mass |

After that, the mixture was heated to a temperature of 60° C., and was then stirred with a TK-homomixer (manufactured by Tokushu Kika Kogyo) at 9,000 r/min for dissolution and dispersion.

8.0 parts by mass of a polymerization initiator 2,2'-azobis (2,4-dimethylvaleronitrile) were dissolved in the resultant, whereby a polymerizable monomer composition was prepared. The above polymerizable monomer composition was loaded into the above aqueous dispersion medium, and the mixture was stirred with the TK-homomixer at a temperature of 60° C. and 15,000 r/min for 10 minutes so as to be granulated.

After that, the resultant was transferred to the propeller type stirring apparatus, and was subjected to a reaction at a temperature of 70° C. for 5 hours while being stirred at 100 r/min. After that, the temperature of the reaction product was increased to 80° C., and the product was subjected to a reaction for an additional 5 hours, whereby toner particles were produced. After the completion of the polymerization reaction, slurry containing the particles was cooled, washed with water in an amount ten times as large as that of the slurry, filtrated, and dried. After that, particle diameters were adjusted by classification, whereby toner particles were obtained.

2.0 parts by mass of a hydrophobic silica fine powder (number average primary particle diameter: 10 nm, BET specific surface area: 170 $m^2/g$) as a flowability improver treated with dimethyl silicone oil (20 mass %) and charged in a triboelectric fashion with polarity identical to that of each of the above toner particles (negative polarity) were mixed in 100 parts by mass of the toner particles with a Henschel mixer (manufactured by Mitsui Miike Machinery Co., Ltd.) at 3,000 r/min for 15 minutes, whereby Toner (A) was obtained. Table 1 shows the physical properties of Toner (A).

Next, the divinylbenzene content of Toner (A) was measured. The divinylbenzene content was measured with a gas chromatography mass spectrometer provided with a pyrolysis apparatus.

A "PYROFOIL SAMPLER JPS-700" manufactured by Japan Analytical Industry Co., Ltd. was used as the pyrolysis apparatus, and a "Trace GCMS" manufactured by Thermo Fisher Scientific K.K. was used as the gas chromatography mass spectrometer. 0.1 mg of the sample was wrapped with a pyrofoil at 590° C., and was set in the pyrolysis apparatus. GC/MS conditions were as follows: a "HP-INNOWAX" manufactured by Agilent Technologies having a column length of 30 m, an inner diameter of 0.25 mm, and a liquid phase of 0.25 μm was used as a column. The temperature of the column was increased under the following conditions: the temperature was increased to 50° C. to 120° C. at 5° C./min and to 200° C. at 10° C./min, and was held at 200° C. for 3 minutes. It should be noted that conditions for the injection port of the GC/MS were set as follows: the temperature of the injection port was 200° C., split analysis was performed, a split flow was 50 mL/min, and a pressure at the injection port was 100 kPa.

The integrated value of the peak of divinylbenzene detected at the time of the analysis under the foregoing conditions was compared with a calibration curve created in advance, and the content was calculated.

As a result, the divinylbenzene content in the binder resin of Toner (A) was 0.022 mass %.

Example 2

A toner was produced in the same manner as in Example 1 except that the addition amount of divinylbenzene was changed to 0.013 part by mass. The resultant toner was defined as Toner (B). In addition, Table 1 shows the physical properties of Toner (B).

Next, the divinylbenzene content was measured in the same manner as in Example 1. As a result, the divinylbenzene content in the binder resin of Toner (B) was 0.012 mass %.

Example 3

A toner was produced in the same manner as in Example 1 except that the addition amount of divinylbenzene was changed to 0.0050 part by mass. The resultant toner was defined as Toner (C). In addition, Table 1 shows the physical properties of Toner (C).

Next, the divinylbenzene content was measured in the same manner as in Example 1. As a result, the divinylbenzene content in the binder resin of Toner (C) was 0.0050 mass %.

Example 4

A toner was produced in the same manner as in Example 1 except that divinylbenzene was not added. The resultant toner was defined as Toner (D). In addition, Table 1 shows the physical properties of Toner (D).

Example 5

A toner was produced in the same manner as in Example 4 except that: the addition amount of styrene was changed to 66.0 parts by mass; and the addition amount of n-butyl acrylate was changed to 34 parts by mass. The resultant toner was defined as Toner (E). In addition, Table 1 shows the physical properties of Toner (E).

Example 6

A toner was produced in the same manner as in Example 4 except that: the addition amount of styrene was changed to 64.0 parts by mass; the addition amount of n-butyl acrylate was changed to 36.0 parts by mass; and the hydrocarbon wax was changed to a hydrocarbon wax in which the peak temperature of the highest endothermic peak was 74° C. (Biber™103 manufactured by Toyo Petrolite Co., Ltd.). The resultant toner was defined as Toner (F). In addition, Table 1 shows the physical properties of Toner (F).

Example 7

A toner was produced in the same manner as in Example 4 except that the sulfonate group-containing resin (Acryl Base FCA-1001-NS manufactured by FUJIKURA KASEI CO., LTD.) was not added. The resultant toner was defined as Toner (G). In addition, Table 1 shows the physical properties of Toner (G).

Example 8

A toner was produced in the same manner as in Example 4 except that 8.0 parts by mass of behenyl behenate (ester wax) in which the peak temperature of the highest endothermic peak was 75° C. were added instead of the hydrocarbon wax. The resultant toner was defined as Toner (H). In addition, Table 1 shows the physical properties of Toner (H).

Example 9

A toner was produced in the same manner as in Example 4 except that the addition amount of the hydrocarbon wax was changed to 3.0 parts by mass. The resultant toner was defined as Toner (I). In addition, Table 1 shows the physical properties of Toner (I).

Example 10

A toner was produced in the same manner as in Example 4 except that the addition amount of the hydrocarbon wax was changed to 27.0 parts by mass. The resultant toner was defined as Toner (J). In addition, Table 1 shows the physical properties of Toner (J).

Example 11

A toner was produced in the same manner as in Example 4 except that: hydrochloric acid was not added in the step of producing the aqueous dispersion medium; and the toner was produced in the aqueous dispersion medium having a pH of 11.0. The resultant toner was defined as Toner (K). In addition, Table 1 shows the physical properties of Toner (K).

Example 12

A toner was produced in the same manner as in Example 4 except that 20.0 parts by mass of a styrene-methacrylic acid-methyl methacrylate-butyl acrylate copolymer having a TgB of 76° C. (styrene/methacrylic acid/methyl methacrylate/butyl acrylate=83.85/2.50/1.65/12.00) were added instead of the styrene-methacrylic acid-methyl methacrylate-α-methylstyrene copolymer used in Example 4. The resultant toner was defined as Toner (L) In addition, Table 1 shows the physical properties of Toner (L).

Example 13

A toner was produced in the same manner as in Example 4 except that 20.0 parts by mass of a styrene-methyl methacrylate-acryloylmorpholine copolymer having a TgB of 124° C. (styrene/methyl methacrylate/acryloylmorpholine=20.00/30.00/50.00) were added instead of the styrene-methacrylic acid-methyl methacrylate-α-methylstyrene copolymer used in Example 4. The resultant toner was defined as Toner (M). In addition, Table 1 shows the physical properties of Toner (M).

Example 14

A toner was produced in the same manner as in Example 4 except that: the addition amount of tricalcium phosphate was changed to 10.8 parts by mass; the addition amount of 10% hydrochloric acid was changed to 13.2 parts by mass; and 1.0 part by mass of tertiary dodecyl mercaptan was further added. The resultant toner was defined as Toner (N). In addition, Table 1 shows the physical properties of Toner (N).

Example 15

A toner was produced in the same manner as in Example 4 except that: the addition amount of tricalcium phosphate was changed to 7.2 parts by mass; the addition amount of 10% hydrochloric acid was changed to 8.8 parts by mass; the addition amount of styrene was changed to 78.0 parts by mass; and the addition amount of n-butyl acrylate was changed to 22.0 parts by mass. The resultant toner was defined as Toner (O). In addition, Table 1 shows the physical properties of Toner (O).

Example 16

A toner was produced in the same manner as in Example 4 except that 20.0 parts by mass of a styrene-methyl methacrylate-acryloylmorpholine copolymer having a TgB of 132° C. (styrene/methyl methacrylate/acryloylmorpholine=3.00/30.00/67.00) were added instead of the styrene-methacrylic acid-methyl methacrylate-α-methylstyrene copolymer used in Example 4. The resultant toner was defined as Toner (P). In addition, Table 1 shows the physical properties of Toner (P).

Example 17

A toner was produced in the same manner as in Example 4 except that the hydrocarbon wax was changed to a hydrocarbon wax in which the peak temperature of the highest endothermic peak was 88° C. (Polywax™500 manufactured by Toyo Petrolite Co., Ltd.). The resultant toner was defined as Toner (Q). In addition, Table 1 shows the physical properties of Toner (Q).

Example 18

A toner was produced in the same manner as in Example 4 except that the hydrocarbon wax was changed to a hydrocarbon wax in which the peak temperature of the highest endothermic peak was 107° C. (Polywax™850 manufactured by Toyo Petrolite Co., Ltd.). The resultant toner was defined as Toner (R). In addition, Table 1 shows the physical properties of Toner (R).

Example 19

A toner was produced in the same manner as in Example 4 except that: the addition amount of styrene was changed to 64.0 parts by mass; the addition amount of n-butyl acrylate was changed to 36.0 parts by mass; and the hydrocarbon wax was changed to a hydrocarbon wax in which the peak temperature of the highest endothermic peak was 107° C. (Polywax™850 manufactured by Toyo Petrolite Co., Ltd.). The resultant toner was defined as Toner (S) In addition, Table 1 shows the physical properties of Toner (S).

Example 20

A toner was produced in the same manner as in Example 4 except that 20.0 parts by mass of a styrene-methacrylic acid-methyl methacrylate-butyl acrylate copolymer having a TgB of 71° C. (styrene/methacrylic acid/methyl methacrylate/butyl acrylate=78.05/2.5/1.65/17.8) were added instead of the styrene-methacrylic acid-methyl methacrylate-α-methylstyrene copolymer used in Example 4. The resultant toner was defined as Toner (T). In addition, Table 1 shows the physical properties of Toner (T).

Comparative Example 1

A toner was produced in the same manner as in Example 4 except that: the addition amount of styrene was changed to 83.0 parts by mass; the addition amount of n-butyl acrylate was changed to 17.0 parts by mass; 8.0 parts by mass of stearyl behenate (ester wax) in which the peak temperature of the highest endothermic peak was 69° C. were added instead of the hydrocarbon wax; and 8.0 parts by mass of a polyester resin (polycondensate of propylene oxide-denatured bisphenol A and isophthalic acid, TgB=65° C., Mw=10,000, Mn=6,000) were added instead of the styrene-methacrylic acid-methyl methacrylate-α-methylstyrene copolymer used in Example 4. The resultant toner was defined as Toner (a). In addition, Table 1 shows the physical properties of Toner (a).

Comparative Example 2

A toner was produced in the same manner as in Example 4 except that 20.0 parts by mass of a styrene-methacrylic acid-methyl methacrylate-butyl acrylate copolymer having a TgB of 67° C. (styrene/methacrylic acid/methyl methacrylate/butyl acrylate=72.35/2.50/1.65/23.50) were added instead of the styrene-methacrylic acid-methyl methacrylate-α-methylstyrene copolymer used in Example 4. The resultant toner was defined as Toner (b). In addition, Table 1 shows the physical properties of Toner (b).

Comparative Example 3

A toner was produced in the same manner as in Example 4 except that polymerization was performed by adding 5 parts by mass of an unsaturated polar resin (Atlac 382A manufactured by Kao Corporation). The resultant toner was defined as Toner (c). In addition, Table 1 shows the physical properties of Toner (c).

Comparative Example 4

A toner was produced in the same manner as in Example 4 except that 8.0 parts by mass of a polyester resin (polycondensate of propyleneoxide-denatured bisphenol A and isophthalic acid, TgB=65° C., Mw=10,000, Mn=6,000) were added instead of the styrene-methacrylic acid-methyl methacrylate-α-methylstyrene copolymer used in Example 4. The resultant toner was defined as Toner (d). In addition, Table 1 shows the physical properties of Toner (d).

Comparative Example 5

A toner was produced in the same manner as in Example 1 except that the addition amount of divinylbenzene was changed to 1.0 part by mass. The resultant toner was defined as Toner (e). In addition, Table 1 shows the physical properties of Toner (e).

Next, the divinylbenzene content was measured in the same manner as in Example 1. As a result, the divinylbenzene content in the binder resin of Toner (e) was 0.98 mass %.

Comparative Example 6

A toner was produced in the same manner as in Example 4 except that: the addition amount of styrene was changed to 55.0 parts by mass; and the addition amount of n-butyl acrylate was changed to 45.0 parts by mass. The resultant toner was defined as Toner (f) In addition, Table 1 shows the physical properties of Toner (f)

Comparative Example 7

A toner was produced in the same manner as in Example 4 except that the hydrocarbon wax was changed to a hydrocarbon wax in which the peak temperature of the highest endothermic peak was 55° C. (WEIS SEN-T-0453 manufactured by NIPPON SEIRO CO., LTD.) Fischer-Tropsch wax. The resultant toner was defined as Toner (g). In addition, Table 1 shows the physical properties of Toner (g).

Comparative Example 8

A toner was produced in the same manner as in Example 4 except that polymerization was performed by adding 1.0 part by mass of divinylbenzene and 8 parts by mass of an unsaturated polar resin (Atlac 382A manufactured by Kao Corporation). The resultant toner was defined as Toner (h). In addition, Table 1 shows the physical properties of Toner (h).

Next, the divinylbenzene content was measured in the same manner as in Example 1. As a result, the divinylbenzene content in the binder resin of Toner (h) was 0.98 mass %.

Comparative Example 9

A toner was produced in the same manner as in Example 4 except that the hydrocarbon wax was changed to a hydrocarbon wax in which the peak temperature of the highest endothermic peak was 113° C. (Polywax™1000 manufactured by Toyo Petrolite Co., Ltd.). The resultant toner was defined as Toner (i). In addition, Table 1 shows the physical properties of Toner (i).

Comparative Example 10

A toner was produced in the same manner as in Example 4 except that: the addition amount of styrene was changed to 80.0 parts by mass; the addition amount of n-butyl acrylate was changed to 20.0 parts by mass; and the hydrocarbon wax was changed to a hydrocarbon wax in which the peak temperature of the highest endothermic peak was 105° C. (LUVAX-1151 manufactured by NIPPON SEIRO CO., LTD.). The resultant toner was defined as Toner (j). In addition, Table 1 shows the physical properties of Toner (j).

Comparative Example 11

A toner was produced in the same manner as in Example 4 except that: the hydrocarbon wax was changed to a hydrocarbon wax in which the peak temperature of the highest endothermic peak was 105° C. (LUVAX-1151 manufactured by NIPPON SEIRO CO., LTD.); and the addition amount of the polymerization initiator was changed to 15 parts by mass. The resultant toner was defined as Toner (k). In addition, Table 1 shows the physical properties of Toner (k).

TABLE 1

| | Toner | Microscopic compression test | | | DSC | | | | Viscosity at 100° C. measured with flow tester |
|---|---|---|---|---|---|---|---|---|---|
| | No. | $R(25) \times 10^{-3}$ | Z(25) | Z(50) | P1 | TgA | P1 − TgA | TgB | ($\times 10^4$ Pa · s) |
| Example 1 | A | 1.26 | 68 | 48 | 77 | 45 | 32 | 96 | 1.9 |
| Example 2 | B | 1.22 | 59 | 35 | 77 | 45 | 32 | 96 | 1.1 |
| Example 3 | C | 1.19 | 56 | 27 | 77 | 45 | 32 | 96 | 0.9 |
| Example 4 | D | 1.18 | 55 | 26 | 77 | 45 | 32 | 96 | 0.8 |
| Example 5 | E | 0.64 | 46 | 20 | 77 | 45 | 32 | 96 | 0.5 |
| Example 6 | F | 0.62 | 45 | 19 | 74 | 40 | 34 | 96 | 0.4 |
| Example 7 | G | 1.18 | 55 | 30 | 77 | 45 | 32 | 96 | 0.9 |
| Example 8 | H | 1.18 | 55 | 26 | 75 | 45 | 30 | 96 | 0.8 |
| Example 9 | I | 1.18 | 55 | 26 | 77 | 45 | 32 | 96 | 0.7 |
| Example 10 | J | 1.18 | 55 | 26 | 77 | 45 | 32 | 96 | 0.8 |
| Example 11 | K | 1.18 | 55 | 26 | 77 | 45 | 32 | 96 | 0.8 |
| Example 12 | L | 1.18 | 55 | 26 | 77 | 45 | 32 | 76 | 0.8 |
| Example 13 | M | 1.18 | 55 | 26 | 77 | 45 | 32 | 124 | 0.8 |
| Example 14 | N | 1.18 | 55 | 26 | 77 | 45 | 32 | 96 | 0.2 |
| Example 15 | O | 1.11 | 74 | 34 | 77 | 59 | 18 | 96 | 2.3 |
| Example 16 | P | 1.25 | 78 | 39 | 77 | 45 | 32 | 132 | 0.8 |
| Example 17 | Q | 1.19 | 57 | 27 | 88 | 45 | 43 | 96 | 0.7 |
| Example 18 | R | 1.21 | 56 | 29 | 107 | 45 | 62 | 96 | 1.1 |
| Example 19 | S | 0.64 | 46 | 20 | 107 | 40 | 67 | 96 | 0.5 |
| Example 20 | T | 0.60 | 49 | 13 | 77 | 45 | 32 | 71 | 1.9 |
| Comparative Example 1 | a | 0.98 | 50 | 42 | 69 | 60 | 9 | 65 | 4.1 |
| Comparative Example 2 | b | 0.51 | 41 | 8 | 77 | 45 | 32 | 67 | 1.7 |
| Comparative Example 3 | c | 1.66 | 74 | 57 | 77 | 45 | 32 | 96 | 2.8 |
| Comparative Example 4 | d | 0.50 | 36 | 8 | 77 | 45 | 32 | 65 | 1.2 |

TABLE 1-continued

| | | | | | | | | | |
|---|---|---|---|---|---|---|---|---|---|
| Comparative Example 5 | e | 1.25 | 85 | 39 | 77 | 45 | 32 | 96 | 13.2 |
| Comparative Example 6 | f | 0.38 | 42 | 12 | 77 | 30 | 47 | 96 | 0.2 |
| Comparative Example 7 | g | 1.20 | 55 | 28 | 55 | 45 | 10 | 96 | 0.3 |
| Comparative Example 8 | h | 1.78 | 78 | 62 | 77 | 45 | 32 | 96 | 25.3 |
| Comparative Example 9 | i | 1.21 | 57 | 28 | 113 | 45 | 68 | 96 | 1.1 |
| Comparative Example 10 | j | 1.39 | 79 | 39 | 105 | 68 | 37 | 96 | 3.6 |
| Comparative Example 11 | k | 0.72 | 41 | 8 | 107 | 40 | 67 | 96 | 0.3 |

| | | | | Wax component | |
|---|---|---|---|---|---|
| | Toner No. | Average circularity | Number average particle diameter of toner (D1) | Kind | Number of added parts |
| Example 1 | A | 0.982 | 5.1 | Hydrocarbon-based wax | 8 |
| Example 2 | B | 0.981 | 4.9 | Hydrocarbon-based wax | 8 |
| Example 3 | C | 0.980 | 5.0 | Hydrocarbon-based wax | 8 |
| Example 4 | D | 0.981 | 5.1 | Hydrocarbon-based wax | 8 |
| Example 5 | E | 0.981 | 4.8 | Hydrocarbon-based wax | 8 |
| Example 6 | F | 0.980 | 5.0 | Hydrocarbon-based wax | 8 |
| Example 7 | G | 0.983 | 5.2 | Hydrocarbon-based wax | 8 |
| Example 8 | H | 0.980 | 5.1 | Ester wax | 8 |
| Example 9 | I | 0.986 | 5.0 | Hydrocarbon-based wax | 3 |
| Example 10 | J | 0.975 | 5.0 | Hydrocarbon-based wax | 27 |
| Example 11 | K | 0.956 | 6.3 | Hydrocarbon-based wax | 8 |
| Example 12 | L | 0.970 | 5.3 | Hydrocarbon-based wax | 8 |
| Example 13 | M | 0.980 | 5.0 | Hydrocarbon-based wax | 8 |
| Example 14 | N | 0.976 | 4.0 | Hydrocarbon-based wax | 8 |
| Example 15 | O | 0.981 | 7.5 | Hydrocarbon-based wax | 8 |
| Example 16 | P | 0.977 | 5.1 | Hydrocarbon-based wax | 8 |
| Example 17 | Q | 0.982 | 4.9 | Hydrocarbon-based wax | 8 |
| Example 18 | R | 0.977 | 4.8 | Hydrocarbon-based wax | 8 |
| Example 19 | S | 0.980 | 5.0 | Hydrocarbon-based wax | 8 |
| Example 20 | T | 0.980 | 5.2 | Hydrocarbon-based wax | 8 |
| Comparative Example 1 | a | 0.976 | 5.0 | Ester wax | 8 |
| Comparative Example 2 | b | 0.987 | 4.9 | Hydrocarbon-based wax | 8 |
| Comparative Example 3 | c | 0.980 | 4.9 | Hydrocarbon-based wax | 8 |
| Comparative Example 4 | d | 0.982 | 5.2 | Hydrocarbon-based wax | 8 |
| Comparative Example 5 | e | 0.977 | 5.0 | Hydrocarbon-based wax | 8 |
| Comparative Example 6 | f | 0.975 | 5.1 | Hydrocarbon-based wax | 8 |
| Comparative Example 7 | g | 0.983 | 5.2 | Hydrocarbon-based wax | 8 |
| Comparative Example 8 | h | 0.973 | 4.8 | Hydrocarbon-based wax | 8 |
| Comparative Example 9 | i | 0.972 | 4.9 | Hydrocarbon-based wax | 8 |
| Comparative Example 10 | j | 0.980 | 5.0 | Hydrocarbon-based wax | 8 |
| Comparative Example 11 | k | 0.978 | 5.1 | Hydrocarbon-based wax | 8 |

Hereinafter, methods for evaluation and evaluation criteria in the present invention will be described.

<Evaluation for Fixing Performance>

(Low-Temperature Fixability/Hot Offset Property/Image Gloss/Winding Performance/Blister Test/Bending Test)

A developer container of a developing assembly based on a one-component, contact developing system shown in FIG. 2 was filled with 85 g of a toner described in any one of the examples and comparative examples, and was left to stand under a normal-temperature, normal-humidity environment (having a temperature of 23.5° C. and a humidity of 60% RH) for 24 hours. At that time, transfer paper was similarly left to stand. After that, the developing assembly shown in FIG. 2 was mounted on the unit c portion of FIG. 3 under the normal-temperature, normal-humidity environment (having a temperature of 23.5° C. and a humidity of 60% RH), and an unfixed image was output according to a cyan monochromatic mode at a process speed of 200 mm/s.

(Low-Temperature Fixability)

An unfixed solid image having a toner laid-on level of 0.6 mg/cm$^2$ was obtained by using plain paper for a copying machine (64-g/m$^2$ paper) as a transfer material. The image was fixed with a fixing device IRC3200 (manufactured by Canon Inc.) at a process speed of 200 mm/s. The fixation temperature was reduced from 200° C. to 130° C. in decrements of 5° C. The image was reciprocated five times with lens-cleaning paper to which a load of 4.9 kPa was applied and the evaluation was performed with the temperature at which a density reduced by 20% or more defined as a fixation minimum temperature.

(Evaluation Standard)

A: The fixation minimum temperature is lower than 145° C.

B: The fixation minimum temperature is 145° C. or higher and lower than 155° C.

C: The fixation minimum temperature is 155° C. or higher and lower than 165° C.

D: The fixation minimum temperature is 165° C. or higher.

(Hot Offset Property)

An unfixed image having the following characteristics was obtained by using a Xerox 4200 (manufactured by Xerox Corporation) (75-g/m$^2$ paper) as a transfer material: the toner laid-on level of the solid image portion of the unfixed image was 0.6 mg/cm$^2$, the entire region from the tip to a portion at a distance of 5 cm from the tip when the A4-size paper was horizontally placed was the solid image portion, and the other region was solid white. The image was fixed with the fixing device IRC3200 at any one of the fixation temperatures set at an interval of 5° C. in the temperature range of 170 to 200° C. The image was fixed at a process speed of 50 mm/s. The level of offset appearing in the white ground part was visually observed. The following levels A, B, and C cause no problems in use, while the following level D causes problems in use.

(Evaluation Standard)

A: No offset occurs.

B: A thin offset occurs at the end of the white ground part when fixation temperature is 200° C.

C: An offset occurs in all of the transfer area when fixation temperature is 200° C.

D: An offset occurs in all of the transfer area when fixation temperature is 190° C.

(Image Gloss)

An unfixed solid image having a toner laid-on level of 0.5 mg/cm$^2$ was obtained by using Xerox 4200 (75-g/m$^2$ paper). The solid image was fixed using a fixing device IRC3200 at a process speed of 100 mm/s and at a fixing temperature of 180° C. An image gloss at a measurement optical portion angle of 75° was measured by using a "PG-3D" (manufactured by NIPPON DENSHOKU INDUSTRIES Co., LTD.)

(Evaluation Standard)

A: The image gloss is 25 or more.

B: The image gloss is 20 or more and less than 25.

C: The image gloss is 18 or more and less than 20.

D: The image gloss is less than 18.

(Fixing Roller Winding Performance)

As the transfer material, a plain paper for a copying machine (64-g/m$^2$ paper) was used for the evaluation. A solid image having a toner laid-on level of 1.1 mg/cm$^2$ was formed on the paper from a position distant from the tip of the transfer paper by 1 mm, whereby an unfixed solid image was obtained. The image was fixed by using a fixing device IRC3200. At this time, a process speed was 150 mm/s and a fixation temperature was reduced from 175° C. in decrements of 5° C. The temperature at which the transfer paper wound around a fixing roller was defined as a fixing roller winding temperature.

(Evaluation Standard)

A: The fixing roller winding temperature is 155° C. or lower.

B: The fixing roller winding temperature is higher than 155° C. and 160° C. or lower.

C: The fixing roller winding temperature is higher than 160° C. and 165° C. or lower.

D: The fixing roller winding temperature is higher than 165° C.

(Blister Test)

An unfixed solid image having a toner laid-on level of 0.6 mg/cm$^2$ was obtained by using plain paper for a copying machine (105-g/m$^2$ paper) as a transfer material. The image was fixed with a fixing device IRC3200 (manufactured by Canon Inc.) at a process speed of 200 mm/s and a fixation temperature of 190° C. Blister is a phenomenon in which part of the image is peeled by a fixing roller at the time of a fixing step owing to the insufficiency of a quantity of heat applied to toner particles. The level of the blister was visually evaluated.

(Evaluation Criteria)

A: No blister occurs.

B: Blister slightly occurs.

C: Blister occurs, but is at such a level that no problem arises.

D: Blister remarkably occurs.

(Bending Test)

An unfixed solid image having a toner laid-on level of 0.6 mg/cm$^2$ was obtained by using plain paper for a copying machine (64-g/m$^2$ paper) as a transfer material. The image was fixed with a fixing device IRC3200 (manufactured by Canon Inc.) at a process speed of 200 mm/s and a fixation temperature of 190° C. After that, the image portion was bent. Conditions for the bending were as follows: a flat weight was reciprocally moved five times along the bent portion while a load of 4.9 kPa was applied to the bent portion with the weight. After that, the bent image portion was reciprocally rubbed five times with lens-cleaning paper to which a load of 4.9 kPa was applied. Then, the percentage by which the image density reduced after the rubbing as compared to the image density before the rubbing was measured.

(Evaluation Criteria)

A: The percentage by which the density reduces is less than 5%.

B: The percentage by which the density reduces is 5% or more and less than 10%.

C: The percentage by which the density reduces is 10% or more and less than 15%.

D: The percentage by which the density reduces is 15% or more.

<Evaluation for Storage Stability>

(Blocking Test)

10 g of a toner were loaded into a 50-ml polycup, and were left to stand in a thermostat at a temperature of 53° C. for 72 hours. The state of the toner after the standing was visually judged as described below.

(Evaluation Criteria)

A: No blocking occurs, and a state substantially identical to the initial state is maintained.

B: The toner tends to agglomerate slightly, but can be collapsed by the rotation of the polycup, so no particular problem arises.

C: The toner tends to agglomerate, but can be collapsed and loosened with hands.

D: The agglomeration of the toner is remarkable (solidification)

<Evaluation for Developing Performance>

(Image Density/Fogging)

A developer container of a developing assembly based on a one-component, contact developing system shown in FIG. 2 was filled with 85 g of a toner described in any one of the examples and comparative examples, and was left to stand under a normal-temperature, normal-humidity environment (having a temperature of 23.5° C. and a humidity of 60% RH) for 24 hours. At that time, transfer paper was similarly left to stand. It should be noted that a Xerox 4200 (manufactured by Xerox Corporation) (75-g/$m^2$ paper) was used as the transfer paper in the evaluation for developing performance. After that, the developing assembly shown in FIG. 2 was mounted on the unit c portion of FIG. 3 under the normal-temperature, normal-humidity environment (having a temperature of 23.5° C. and a humidity of 60% RH), and continuous output was performed on a chart having a print percentage of 2% according to a cyan monochromatic mode at a process speed of 200 mm/s. The evaluation for developing performance was performed at an initial stage (first sheet), a 5,000-th sheet, and a 10,000-th sheet, and an image density and fogging were identified by the following methods.

(Image Density)

A relative density for an image having a white ground part with an original density of 0.00 was measured as an image density by using a "Macbeth reflection densitometer RD918" (manufactured by GretagMacbeth).

(Evaluation Standard)

A: The image density is 1.40 or more.

B: The image density is 1.30 or more and less than 1.40.

C: The image density is 1.20 or more and less than 1.30.

D: The image density is 1.10 or more and less than 1.20.

(Fogging)

In the fogging evaluation method, a fogging density (%) (=Dr (%)−Ds (%)) was calculated from a difference between the degree of whiteness of the white ground part of the printed-out image (reflectivity Ds (%)) and the degree of whiteness of transfer paper (average reflectivity Dr (%)) measured by using a "REFLECTMETER MODEL TC-6DS" (manufactured by Tokyo Denshoku), and evaluation for image fogging upon completion of the duration evaluation was performed. An amberlite filter was used as a filter.

(Evaluation Standard)

A: The fogging density is less than 0.5%.

B: The fogging density is 0.5% or more and less than 1.0%.

C: The fogging density is 1.0% or more and less than 1.5%.

D: The fogging density is 1.5% or more.

<Evaluation for Transferring Performance>

(Transfer Efficiency/Transfer Uniformity)

As in the case of the evaluation for developing performance, a developer container of a developing assembly based on a one-component, contact developing system shown in FIG. 2 was filled with 85 g of a toner described in any one of the examples and comparative examples, and was left to stand under a high-temperature, high-humidity environment (having a temperature of 30° C. and a humidity of 85% RH) for 24 hours. At that time, transfer paper was similarly left to stand. After that, the developing assembly shown in FIG. 2 was mounted on the unit c portion of FIG. 3. Continuous output was performed on a chart having a print percentage of 2% under the high-temperature, high-humidity environment (having a temperature of 30° C. and a humidity of 85% RH) according to a cyan monochromatic mode at a process speed of 200 mm/s. The evaluation for each of transfer efficiency and transfer uniformity was performed at an initial stage (first sheet), a 5,000-th sheet, and a 10,000-th sheet.

(Transfer Efficiency)

A Xerox 4200 (75-g/$m^2$ paper) was used as transfer paper. The power source of the main body of the developing assembly was forcedly turned off during the output of an entirely solid image (having a toner laid-on level of 0.55 mg/$cm^2$) on one sheet (during a transferring step). The mass of the toner before transfer on a photosensitive drum per unit area and the mass of the toner transferred onto the transfer material per unit area were measured, and the transfer efficiency was measured by the following equation.

Transfer efficiency=100×(toner transferred onto transfer material/toner before transfer on photosensitive drum)

(Evaluation Criteria)

A: The transfer efficiency is 90% or more.

B: The transfer efficiency is 82% or more and less than 90%.

C: The transfer efficiency is 75% or more and less than 82%.

D: The transfer efficiency is less than 75%.

(Transfer Uniformity)

A Fox River Bond (Fox River Paper) (90-g/$m^2$ paper) was used as transfer paper. Entirely halftone images each having a toner laid-on level of 0.20 mg/$cm^2$ were each visually evaluated for transfer uniformity.

Judgement criteria are described below.

(Evaluation Criteria)

A: All images each show transfer uniformity in the Fox River Bond at such a good level that no problem in use arises.

B: Some of the images are slightly poor in transfer uniformity in the Fox River Bond.

C: Some of the images are poor in transfer uniformity in the Fox River Bond.

D: The images are remarkably poor in transfer uniformity in the Fox River Bond.

(Evaluation Tests 1 to 20 and Comparative Evaluation Tests 1 to 11)

Table 2 shows the results of the evaluation of Toners (A) to (T) and Toners (a) to (k) for the above items.

TABLE 2

| | Toner No. | Evaluation for fixing performance | | | | | |
|---|---|---|---|---|---|---|---|
| | | Low-temperature fixability | Hot offset property | Image gloss | Winding performance | Blister test | Bending test |
| Evaluation Test 1 | A | A | A | A | A | A | A |
| Evaluation Test 2 | B | A | A | A | A | A | A |
| Evaluation Test 3 | C | A | A | A | A | A | B |
| Evaluation Test 4 | D | A | A | A | A | A | B |
| Evaluation Test 5 | E | A | A | A | A | A | B |
| Evaluation Test 6 | F | A | A | A | A | B | B |
| Evaluation Test 7 | G | A | A | A | A | B | A |
| Evaluation Test 8 | H | A | B | B | A | B | B |
| Evaluation Test 9 | I | A | B | B | B | B | B |
| Evaluation Test 10 | J | A | A | A | A | B | B |
| Evaluation Test 11 | K | A | A | A | A | B | B |
| Evaluation Test 12 | L | A | B | A | A | B | B |
| Evaluation Test 13 | M | C | A | B | B | C | C |
| Evaluation Test 14 | N | A | B | A | B | B | B |
| Evaluation Test 15 | O | C | B | C | B | B | B |
| Evaluation Test 16 | P | C | B | C | C | C | C |
| Evaluation Test 17 | Q | B | A | A | A | B | B |
| Evaluation Test 18 | R | C | A | B | B | C | C |
| Evaluation Test 19 | S | C | A | B | C | C | B |
| Evaluation Test 20 | T | A | B | A | B | C | C |
| Comparative Evaluation Test 1 | a | B | C | A | B | B | B |
| Comparative Evaluation Test 2 | b | A | B | A | C | C | D |
| Comparative Evaluation Test 3 | c | C | B | C | C | D | C |
| Comparative Evaluation Test 4 | d | B | D | A | B | B | B |
| Comparative Evaluation Test 5 | e | D | C | D | C | C | C |
| Comparative Evaluation Test 6 | f | B | D | B | C | C | C |
| Comparative Evaluation Test 7 | g | D | C | C | D | D | D |
| Comparative Evaluation Test 8 | h | D | C | D | D | D | C |
| Comparative Evaluation Test 9 | i | D | A | C | D | D | D |
| Comparative Evaluation Test 10 | j | D | B | D | C | D | D |
| Comparative Evaluation Test 11 | k | B | D | A | D | B | B |

| | Toner No. | Evaluation for storage stability | Evaluation for developing performance | | Evaluation for transferring performance | |
|---|---|---|---|---|---|---|
| | | Blocking | Image density | Fogging | Transfer efficiency | Transfer uniformity |
| Evaluation Test 1 | A | A | A/A/A | A/A/A | A/A/A | A/A/A |
| Evaluation Test 2 | B | A | A/A/A | A/A/A | A/A/A | A/A/A |
| Evaluation Test 3 | C | A | A/A/A | A/A/A | A/A/A | A/A/A |
| Evaluation Test 4 | D | A | A/A/A | A/A/A | A/A/A | A/A/A |
| Evaluation Test 5 | E | A | A/A/A | A/A/A | A/A/A | A/A/A |
| Evaluation Test 6 | F | A | A/A/A | A/A/A | A/A/A | A/A/A |
| Evaluation Test 7 | G | A | A/A/B | A/A/A | A/A/A | A/A/A |
| Evaluation Test 8 | H | A | A/A/A | A/A/A | A/A/A | A/A/A |
| Evaluation Test 9 | I | A | A/A/A | A/A/A | A/A/A | A/A/A |
| Evaluation Test 10 | J | B | A/A/B | A/A/B | A/B/B | A/A/B |
| Evaluation Test 11 | K | A | A/A/B | A/A/B | B/B/B | B/B/B |
| Evaluation Test 12 | L | C | A/A/B | A/A/B | B/B/B | B/B/B |
| Evaluation Test 13 | M | A | A/A/B | A/A/B | A/B/B | A/A/B |
| Evaluation Test 14 | N | C | A/A/B | A/B/B | B/B/B | B/B/B |
| Evaluation Test 15 | O | A | A/A/A | A/A/A | A/A/A | A/A/A |
| Evaluation Test 16 | P | A | A/B/C | A/C/C | B/C/C | A/B/C |
| Evaluation Test 17 | Q | A | A/A/A | A/A/A | A/A/A | A/A/A |
| Evaluation Test 18 | R | A | A/A/A | A/A/A | A/A/A | A/A/A |
| Evaluation Test 19 | S | C | A/A/B | A/A/B | A/A/A | A/A/A |
| Evaluation Test 20 | T | C | B/C/C | B/C/C | B/C/C | B/B/C |
| Comparative Evaluation Test 1 | a | C | B/C/C | C/C/C | B/B/D | B/C/D |
| Comparative Evaluation Test 2 | b | C | B/C/C | B/C/C | B/C/C | B/B/C |

TABLE 2-continued

| | | | | | | |
|---|---|---|---|---|---|---|
| Comparative Evaluation Test 3 | c | A | A/B/C | A/C/C | B/C/C | A/B/C |
| Comparative Evaluation Test 4 | d | C | B/C/D | C/C/D | B/C/D | C/C/D |
| Comparative Evaluation Test 5 | e | A | B/C/D | C/C/C | C/C/D | C/C/D |
| Comparative Evaluation Test 6 | f | D | C/C/D | C/C/D | C/D/D | C/D/D |
| Comparative Evaluation Test 7 | g | C | C/C/D | C/C/D | C/D/D | C/D/D |
| Comparative Evaluation Test 8 | h | A | C/C/D | C/C/D | C/D/D | C/D/D |
| Comparative Evaluation Test 9 | i | A | A/A/A | A/A/A | A/A/A | A/A/A |
| Comparative Evaluation Test 10 | j | A | A/A/A | A/A/A | A/A/A | A/A/A |
| Comparative Evaluation Test 11 | k | D | B/C/C | C/C/C | B/B/D | B/C/D |

Each of the items concerning developing performance and transferring performance shows the results of evaluation at an initial stage, a 5,000-th sheet, and a 10,000-th sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-257590, filed Oct. 1, 2007, and Japanese Patent Application No. 2008-101528, filed Apr. 9, 2008 which are hereby incorporated by reference herein in their entirety.

What is claimed is:

1. A toner, comprising:

toner particles each containing at least a binder resin, a colorant, and a wax component; and an inorganic fine powder, characterized in that:

in a case where, in a microscopic compression test on the toner at a measurement temperature of Y° C., a displacement (μm) obtained when a load is applied to one particle of the toner at a loading rate of $9.8\times10^{-5}$ N/sec to reach a maximum load of $2.94\times10^{-4}$ N is defined as a displacement $X_{2(Y)}$, a displacement (μm) obtained when the particle is left to stand for 0.1 second at the maximum load after the load has reached the maximum load is defined as a maximum displacement $X_{3(Y)}$, a displacement (μm) obtained when the load is reduced at an unloading rate of $9.8\times10^{-5}$ N/sec to reach 0 N after the standing for 0.1 second is defined as a displacement $X_{4(Y)}$, a difference between the maximum displacement $X_{3(Y)}$ and the displacement $X_{4(Y)}$ is defined as an elastic displacement $(X_{3(Y)}-X_{4(Y)})$, and a percentage $[\{(X_{3(Y)}-X_{4(Y)})/X_{3(Y)}\}\times100$: recovery ratio] of the elastic displacement $(X_{3(Y)}-X_{4(Y)})$ to the maximum displacement $X_{3(Y)}$ is represented by Z(Y) (%), Z(25) when the measurement temperature Y is 25° C. satisfies a relationship of $40\leqq Z(25)\leqq80$, and Z(50) when the measurement temperature Y is 50° C. satisfies a relationship of $10\leqq Z(50)\leqq55$;

when, in a load-displacement curve obtained by plotting a load and a displacement in the microscopic compression test on the toner at a measurement temperature of 25° C., a gradient of the load-displacement curve from the origin to the maximum load is represented by R(25) [$2.94\times10^{-4}$/displacement $X_{2(25)}$] (N/μm), R(25) satisfies a relationship of $0.49\times10^{-3}\leqq R(25)\leqq1.70\times10^{-3}$; and the toner has a glass transition temperature (TgA) measured with a differential scanning calorimeter (DSC) of 40° C. or higher and 60° C. or lower and a peak temperature (P1) of a highest endothermic peak measured with the DSC of 70° C. or higher and 110° C. or lower, and the peak temperature (P1) of the highest endothermic peak and the glass transition temperature (TgA) satisfy a relationship of 15° C.$\leqq$(P1−TgA)$\leqq$70° C.

2. A toner according to claim 1, characterized in that the binder resin contains 0.0050 to 0.025 mass % of divinylbenzene.

3. A toner according to claim 1, characterized in that Z (50) satisfies a relationship of $20\leqq Z(50)\leqq50$.

4. A toner according to claim 1, characterized in that Z(50) satisfies a relationship of $30\leqq Z(50)\leqq50$.

5. A toner according to claim 1, characterized in that Z(25) satisfies a relationship of $45\leqq Z(25)\leqq70$.

6. A toner according to claim 1, wherein the toner has a viscosity at a temperature of 100° C. measured by the flow tester heating method of $0.3\times10^4$ Pa·s or more and $2.0\times10^4$ Pa·s or less.

7. A toner according to claim 1, wherein the toner particles each contain a polar resin, and the polar resin has a glass transition temperature (TgB) measured with a differential scanning calorimeter (DSC) of 80° C. or higher and 120° C. or lower.

8. A toner according to claim 1, wherein the toner particles each contain a polymer having a sulfonic group, a sulfonate group, or a sulfonic acid ester group.

9. A toner according to claim 1, wherein the toner particles are produced in an aqueous dispersion medium.

10. A toner according to claim 1, wherein the toner particles are obtained by dispersing a polymerizable monomer composition containing at least a polymerizable monomer to be used in the production of the binder resin, the colorant, and the wax component in the aqueous dispersion medium to granulate the polymerizable monomer composition and polymerizing the polymerizable monomer.

* * * * *